US011033076B2

(12) United States Patent
Greene

(10) Patent No.: US 11,033,076 B2
(45) Date of Patent: Jun. 15, 2021

(54) ARTICLE OF FOOTWEAR HAVING AN UPPER WITH CORD ELEMENTS

(71) Applicant: NIKE, Inc., Beaverton, OR (US)

(72) Inventor: Pamela S. Greene, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 107 days.

(21) Appl. No.: 15/459,994

(22) Filed: Mar. 15, 2017

(65) Prior Publication Data

US 2017/0181500 A1 Jun. 29, 2017

Related U.S. Application Data

(60) Continuation of application No. 14/469,039, filed on Aug. 26, 2014, now Pat. No. 9,622,542, which is a (Continued)

(51) Int. Cl.
*A43B 23/02* (2006.01)
*A43B 13/04* (2006.01)
(Continued)

(52) U.S. Cl.
CPC ..... *A43B 23/027* (2013.01); *A43B 13/04* (2013.01); *A43B 13/122* (2013.01); *A43B 13/125* (2013.01); *A43B 13/181* (2013.01); *A43B 13/187* (2013.01); *A43B 13/223* (2013.01); *A43B 23/025* (2013.01); *A43B 23/026* (2013.01); *A43B 23/0245* (2013.01); (Continued)

(58) Field of Classification Search
CPC ..... A43C 1/00; A43C 1/04; A43B 23/0245; A43B 23/025; A43B 23/026; A43B 23/0265
USPC ..... 36/50.1, 51
See application file for complete search history.

(56) References Cited

U.S. PATENT DOCUMENTS 1,597,934 A 8/1926 Stimpson
1,888,172 A 11/1932 Joha
(Continued)

FOREIGN PATENT DOCUMENTS

CN 1228682 9/1999
CN 101627843 1/2010
(Continued)

OTHER PUBLICATIONS

First Office Action and Search Report, dated Jan. 7, 2015, for corresponding Chinese Application No. CN201280035524.3.
(Continued)

*Primary Examiner* — Jila M Mohandesi
(74) *Attorney, Agent, or Firm* — Klarquist Sparkman, LLP

(57) ABSTRACT

The embodiments relate to an article of footwear and method of manufacturing that includes a first layer and a second layer configured to form a plurality of tunnels configured to receive a cord system. The manufacturing includes steps of placing a first layer, placing a cord on the first layer, securing the cord on the first layer, placing a second layer on the first layer and the cord, attaching the second layer to the first layer, and detaching the cord from the first layer. When the cord is secured with a thread, the thread may be removed by dissolving or cutting. The attaching of the second layer to the first layer can be completed by stitching or thermal welding, for example.

18 Claims, 24 Drawing Sheets

Related U.S. Application Data division of application No. 13/184,715, filed on Jul. 18, 2011, now Pat. No. 8,844,167.

(51) Int. Cl.

| | |
|---|---|
| ***A43B 13/12*** | (2006.01) |
| ***A43B 13/18*** | (2006.01) |
| ***A43B 13/22*** | (2006.01) |
| ***A43C 1/04*** | (2006.01) |
| ***A43C 1/00*** | (2006.01) |

(52) U.S. Cl.

CPC ..... *A43B 23/0265* (2013.01); *A43B 23/0275* (2013.01); *A43C 1/00* (2013.01); *A43C 1/04* (2013.01)

(56) References Cited

U.S. PATENT DOCUMENTS

| | | | | |
|---|---|---|---|---|
| 1,902,780 | A | 3/1933 | Holden et al. | |
| 1,910,251 | A | 5/1933 | Joha | |
| 2,001,293 | A | 5/1935 | Wilson | |
| 2,047,724 | A | 7/1936 | Zuckerman | |
| 2,147,197 | A | 2/1939 | Glidden | |
| 2,149,552 | A | 3/1939 | Schlesinger et al. | |
| 2,330,199 | A | 9/1943 | Basch | |
| 2,400,692 | A | 5/1946 | Herbert | |
| 2,586,045 | A | 2/1952 | Hoza | |
| 2,641,004 | A | 6/1953 | Whiting et al. | |
| 2,675,631 | A | 4/1954 | Doughty | |
| 3,694,940 | A | 10/1972 | Stohr | |
| 4,211,806 | A | 7/1980 | Civardi et al. | |
| 4,255,949 | A | 3/1981 | Thorneburg | |
| 4,317,292 | A | 3/1982 | Melton | |
| 4,373,361 | A | 2/1983 | Thorneburg | |
| 4,447,967 | A | 5/1984 | Zaino | |
| 4,607,439 | A | 8/1986 | Sogabe et al. | |
| 4,756,098 | A | 7/1988 | Boggia | |
| 4,785,558 | A * | 11/1988 | Shiomura | A43B 1/04 36/114 |
| 4,813,158 | A | 3/1989 | Brown | |
| 5,095,720 | A | 3/1992 | Tibbals, Jr. | |
| 5,345,638 | A | 9/1994 | Nishida | |
| 5,353,524 | A | 10/1994 | Brier | |
| 5,461,884 | A | 10/1995 | McCartney et al. | |
| 5,511,323 | A | 4/1996 | Dahlgren | |
| 5,601,907 | A * | 2/1997 | Matsumoto | D03D 3/00 428/131 |
| 5,735,145 | A | 4/1998 | Pernick | |
| 5,746,013 | A | 5/1998 | Fay | |
| 6,029,376 | A * | 2/2000 | Cass | A43C 1/04 36/50.1 |
| 6,074,965 | A * | 6/2000 | Bodenschatz | A61F 13/00038 428/295.4 |
| 6,170,175 | B1 | 1/2001 | Funk | |
| 6,308,438 | B1 | 10/2001 | Throneburg et al. | |
| 6,558,784 | B1 | 5/2003 | Norton et al. | |
| 6,910,288 | B2 | 6/2005 | Dua | |
| 6,931,762 | B1 | 8/2005 | Dua | |
| 7,051,460 | B2 | 5/2006 | Orei et al. | |
| 7,293,371 | B2 | 11/2007 | Aveni | |
| 7,347,011 | B2 | 3/2008 | Dua | |
| 7,568,298 | B2 | 8/2009 | Kerns | |
| 7,574,818 | B2 | 8/2009 | Meschter | |
| 7,942,993 | B2 | 5/2011 | Gessler et al. | |
| 8,453,357 | B2 | 6/2013 | Beers et al. | |
| 2002/0078599 | A1 | 6/2002 | Delgorgue et al. | |
| 2003/0126762 | A1 | 7/2003 | Tseng | |
| 2004/0118018 | A1 | 6/2004 | Dua | |
| 2004/0181972 | A1 * | 9/2004 | Csorba | A43C 11/14 36/50.1 |
| 2005/0115284 | A1 | 6/2005 | Dua | |
| 2005/0193592 | A1 | 9/2005 | Dua et al. | |
| 2005/0284000 | A1 | 12/2005 | Kerns | |
| 2008/0110048 | A1 * | 5/2008 | Dua | A43B 1/04 36/45 |
| 2008/0110049 | A1 * | 5/2008 | Sokolowski | A43B 3/0031 36/50.1 |
| 2010/0154256 | A1 * | 6/2010 | Dua | A43B 1/04 36/25 R |
| 2010/0251564 | A1 * | 10/2010 | Meschter | A43B 23/0225 36/28 |
| 2011/0041359 | A1 | 2/2011 | Dojan et al. | |

FOREIGN PATENT DOCUMENTS

| | | |
|---|---|---|
| WO | WO 9843506 | 10/1998 |
| WO | WO 2010106502 | 9/2010 |
| WO | WO 2012106502 | 8/2012 |

OTHER PUBLICATIONS

International Search Report and Written Opinion, dated Dec. 11, 2012, for corresponding International Patent Application No. PCT/US2012/046862.

Office Action, dated Sep. 23, 2015, for corresponding Chinese Application No. CN2012800355243.3.

Response to Office Action, filed Dec. 8, 2015, for corresponding Chinese Application No. CN201280035524.3, and English translation.

* cited by examiner

ARTICLE OF FOOTWEAR HAVING AN UPPER WITH CORD ELEMENTS

CROSS REFERENCE TO RELATED APPLICATIONS

This application is a continuation of U.S. patent application Ser. No. 14/469,039, filed Aug. 26, 2014, which is a divisional of U.S. patent application Ser. No. 13/184,715, filed Jul. 18, 2011, the entirety of each of which is hereby incorporated by reference.

BACKGROUND

Articles of footwear generally include two primary elements: an upper and a sole structure. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust fit of the footwear, as well as permitting entry and removal of the foot from the void within the upper. In addition, the upper may include a tongue that extends under the lacing system to enhance adjustability and comfort of the footwear, and the upper may incorporate a heel counter.

The various material elements forming the upper impart different properties to different areas of the upper. For example, textile elements may provide breathability and may absorb moisture from the foot, foam layers may compress to impart comfort, and leather may impart durability and wear-resistance. As the number of material elements increases, the overall mass of the footwear may increase proportionally. The time and expense associated with transporting, stocking, cutting, and joining the material elements may also increase. Additionally, waste material from cutting and stitching processes may accumulate to a greater degree as the number of material elements incorporated into an upper increases. Moreover, products with a greater number of material elements may be more difficult to recycle than products formed from fewer material elements. By decreasing the number of material elements, therefore, the mass of the footwear and waste may be decreased, while increasing manufacturing efficiency and recyclability.

The sole structure is secured to a lower portion of the upper so as to be positioned between the foot and the ground. In athletic footwear, for example, the sole structure includes a midsole and an outsole. The midsole may be formed from a polymer foam material that attenuates ground reaction forces (i.e., provides cushioning) during walking, running, and other ambulatory activities. The midsole may also include fluid-filled chambers, plates, moderators, or other elements that further attenuate forces, enhance stability, or influence the motions of the foot, for example. The outsole forms a ground-contacting element of the footwear and is usually fashioned from a durable and wear-resistant rubber material that includes texturing to impart traction. The sole structure may also include a sockliner positioned within the upper and proximal to a lower surface of the foot to enhance footwear comfort.

SUMMARY

An article of footwear is described below as having an upper and a sole structure secured to the upper. In one aspect, a method of manufacturing an article of footwear includes placing a cord on a bottom layer, temporarily securing the cord to the bottom layer, placing a second layer on the bottom layer, where the cord is disposed between the second layer and the bottom layer. The method also includes attaching the second layer to the bottom layer, where the second layer and bottom layer are configured to form a plurality of tunnels for receiving the cord. The method also includes detaching the cord from the bottom layer and creating an upper with the bottom layer, the second layer, and the cord.

In another aspect a method of manufacturing an article of footwear includes placing a cord on a bottom layer, stitching the cord to the bottom layer with a first thread, and placing a second layer on the bottom layer, where the cord is disposed between the second layer and the bottom layer. The method also includes attaching the second layer to the bottom layer, where the second layer and bottom layer are configured to form a plurality tunnels for receiving the cord. The method also includes removing the first thread and forming a loop from a portion of the cord, the loop being disposed outside of the plurality of tunnels and wherein the loop is configured to receive a lace. The method also includes forming an upper with the bottom layer, the second layer, and the cord.

In another aspect an article of footwear includes a sole structure and an upper. The upper includes a bottom layer and a second layer fixed to the bottom layer to create a tunnel system comprising a plurality of tunnels. The upper also includes at least one cord, where the cord is configured to be received by the tunnel system and where the cord is capable of moving longitudinally through the tunnel system. The upper also includes a lacing system in a lacing region, where cord elements of the cord are configured to form a plurality of loops to weave through the lacing system. Two or more of the plurality of loops are formed by a single cord and the cord elements are exposed from the tunnel system in at least one region of the upper.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

Figure 27:
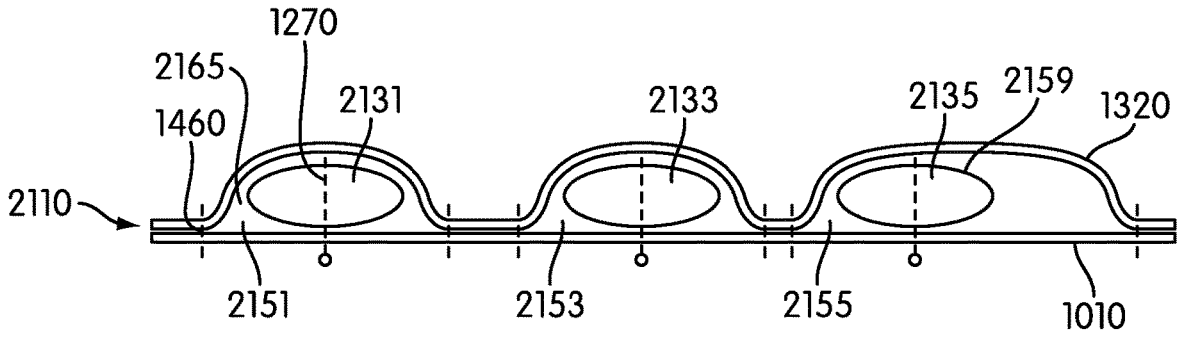
Figure 28:
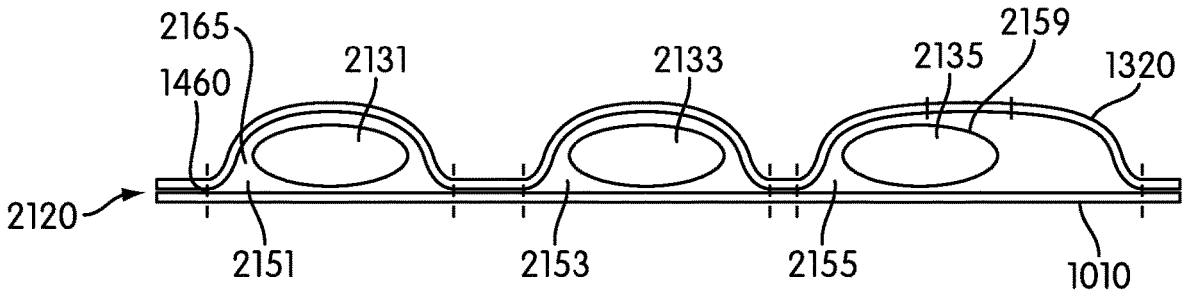
Figure 29:
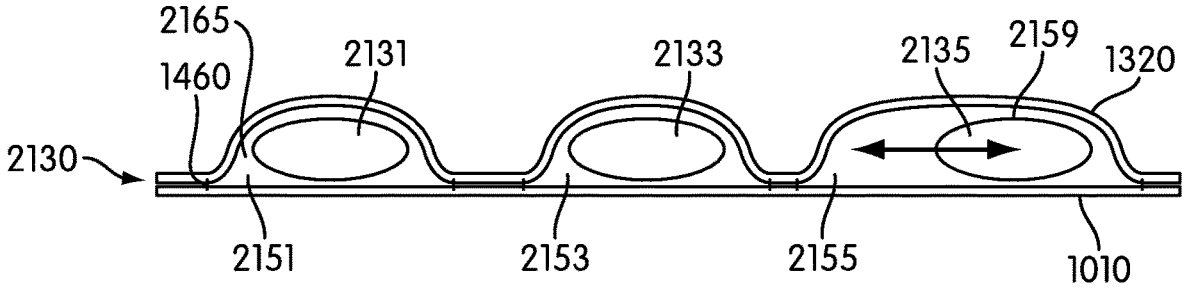
Figure 30:
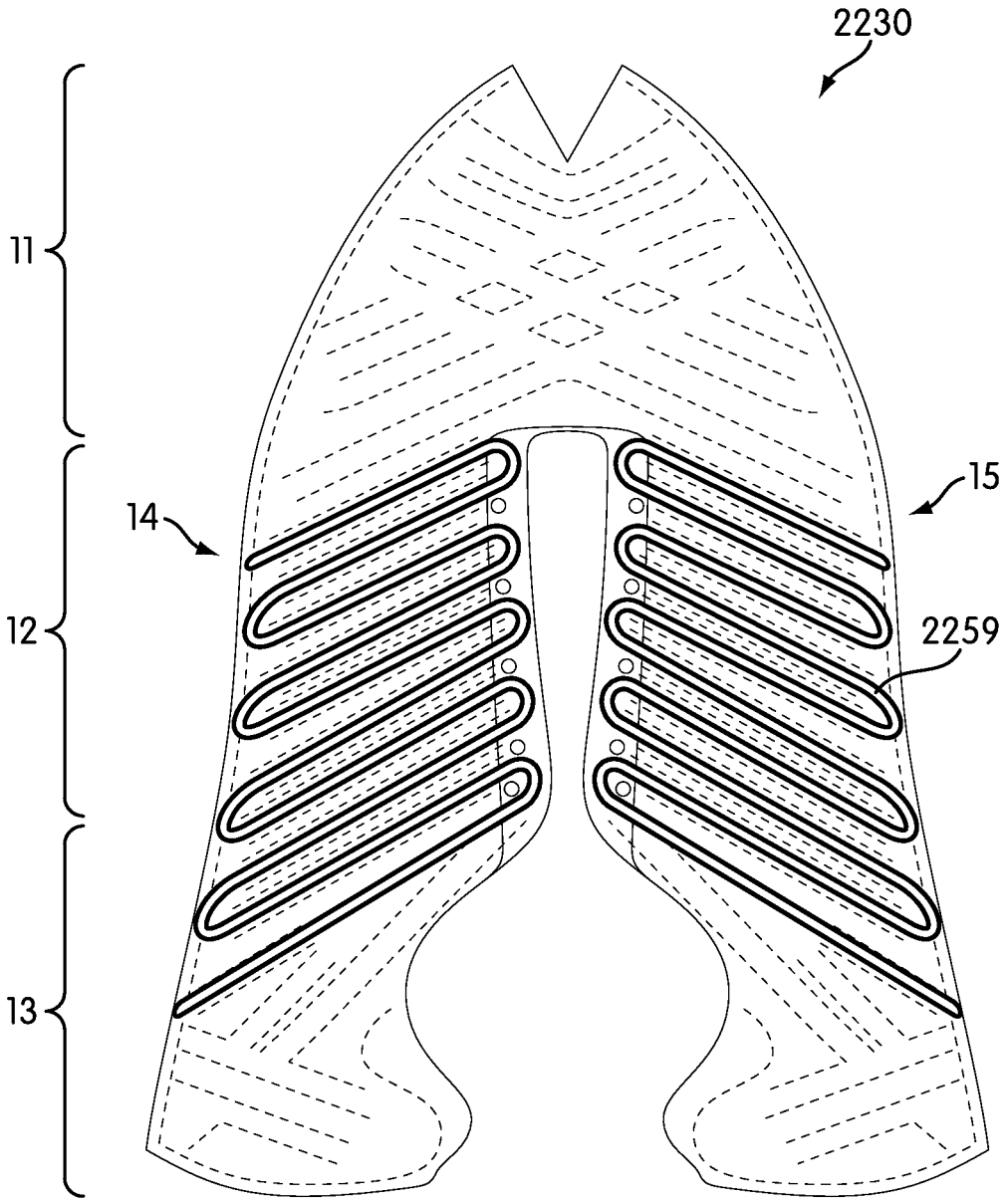
Figure 31:
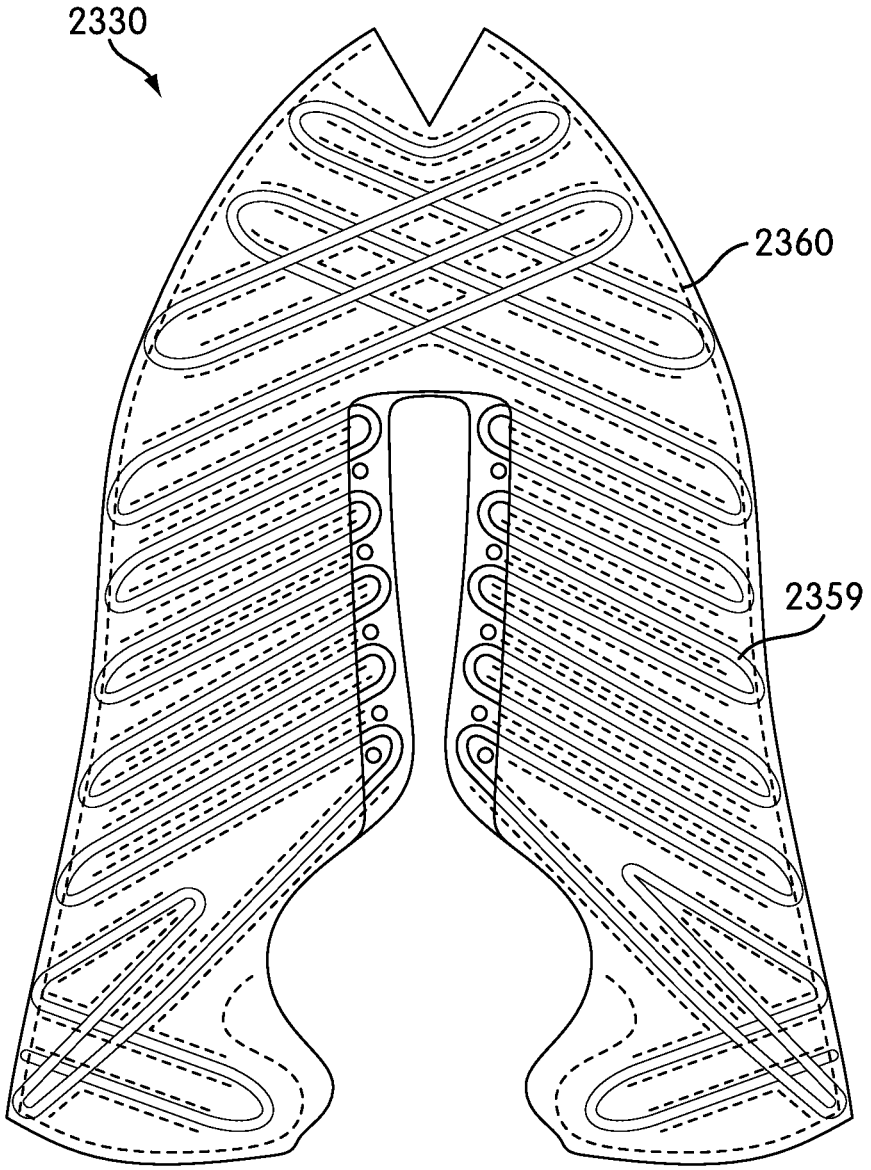
Figure 32:
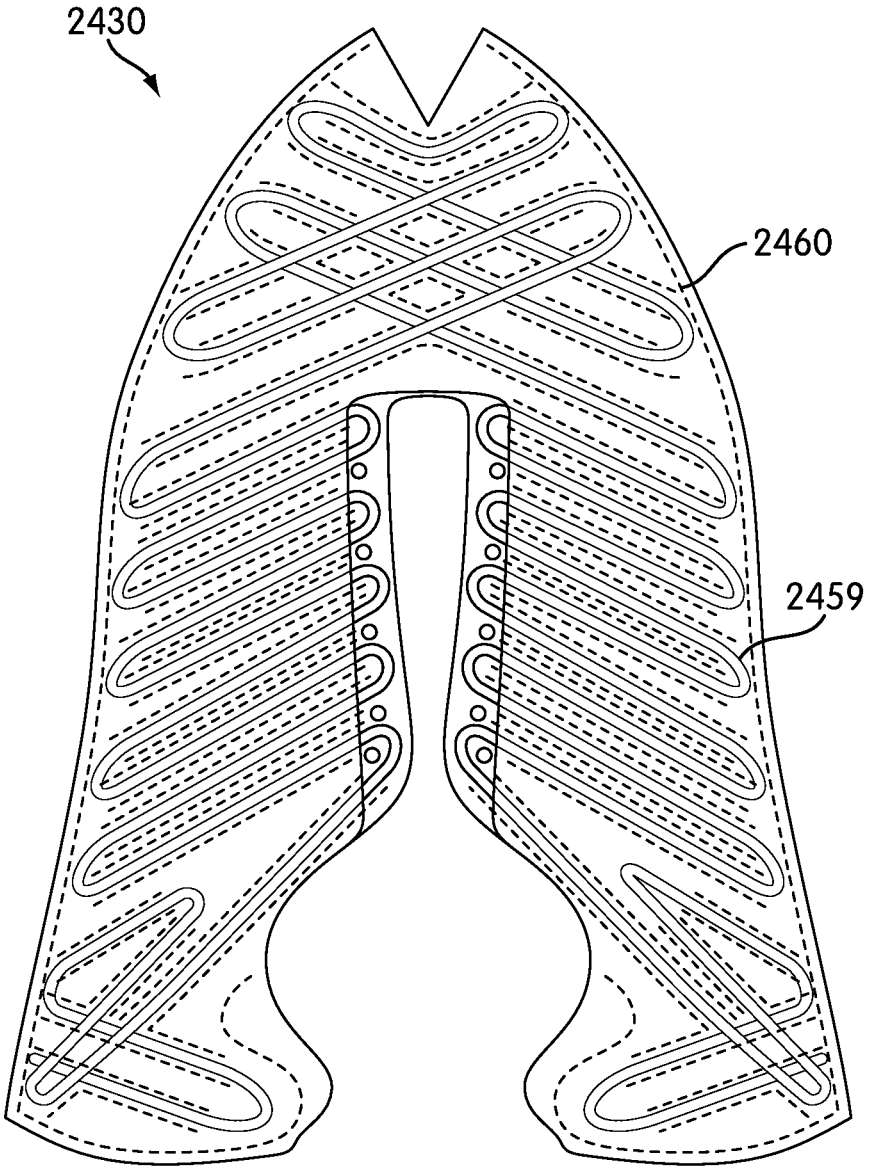
Figure 33:
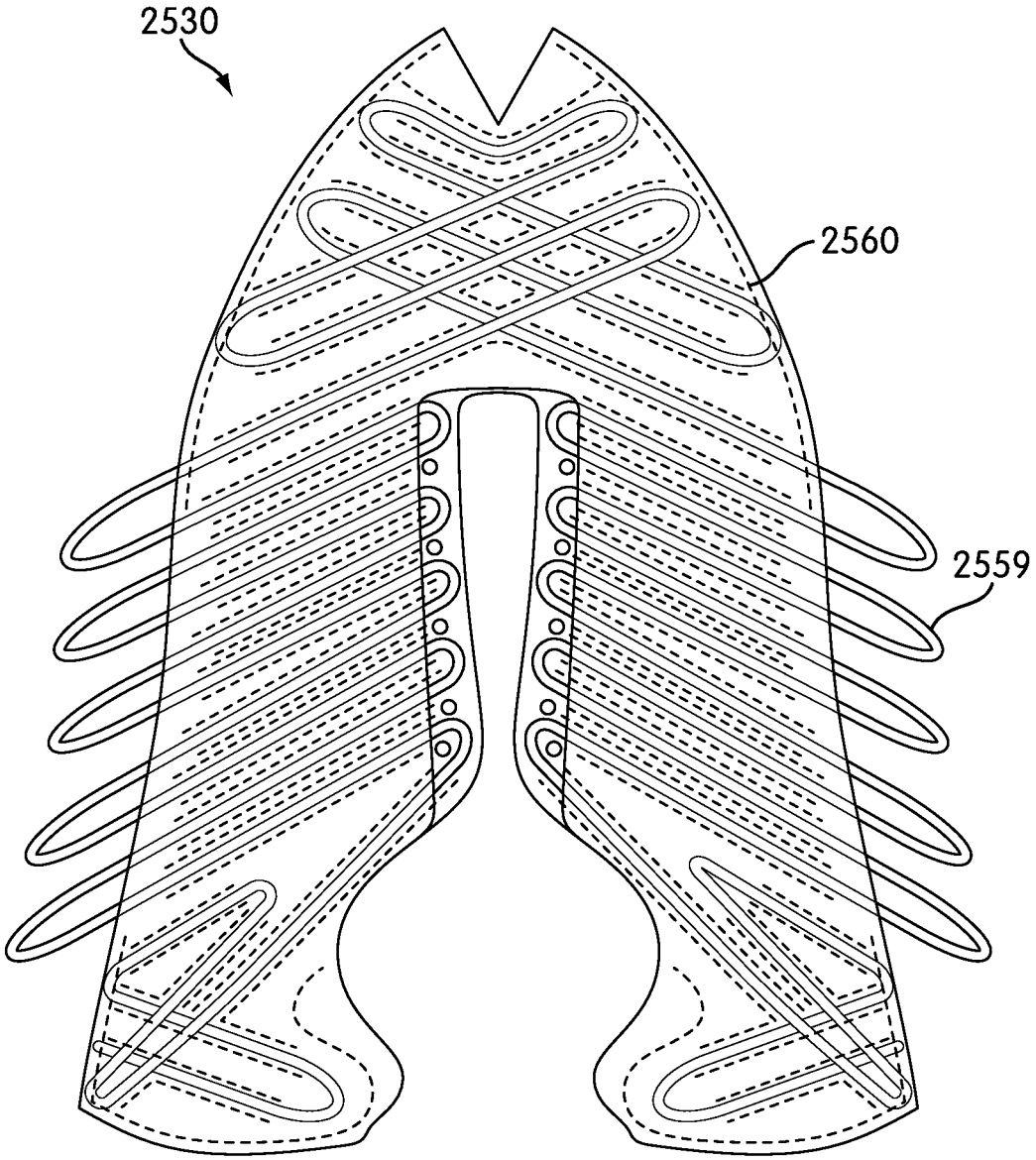
Figure 34:
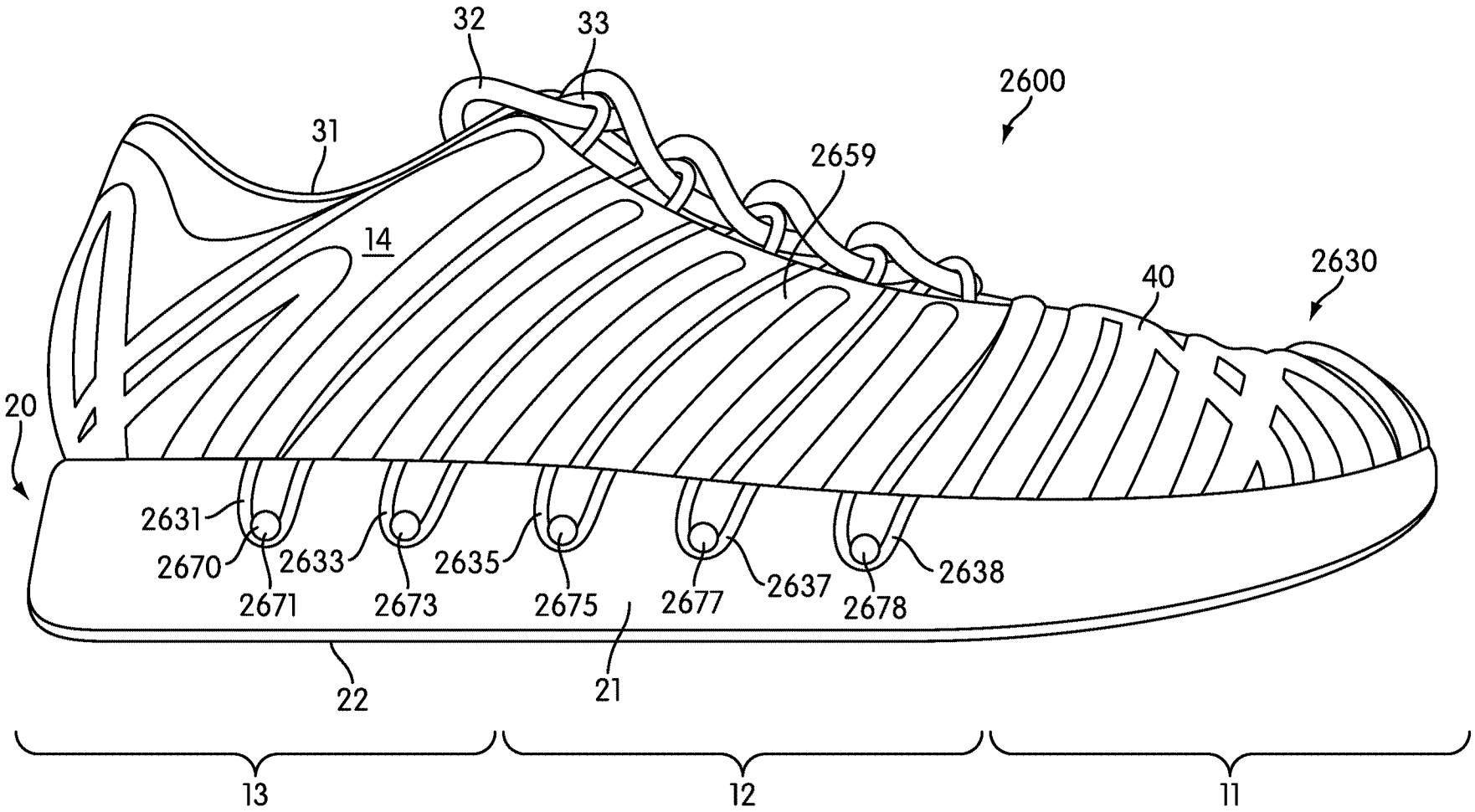

FIGS. 27-29 a cross-sectional views of an embodiment of a plurality of cord elements of cord a system;

FIG. 30 is an embodiment of an alternative configuration of a cord system;

FIG. 31 is a schematic view of an embodiment of an upper with a fully stitched perimeter;

FIG. 32 shows a schematic view of an embodiment of an upper with a partially stitched perimeter;

FIG. 33 shows a schematic view of an embodiment of an upper with a fully stitched perimeter without cord elements stitched into the perimeter; and FIG. 34 is a side elevational view of an embodiment of an article of footwear with a partially stitched parameter.

DETAILED DESCRIPTION

The following discussion and accompanying figures disclose an article of footwear having an upper that includes a cord element. The article of footwear is disclosed as having a general configuration suitable for walking or running. Concepts associated with the footwear, including the upper, may also be applied to a variety of other athletic footwear types, including baseball shoes, basketball shoes, cross-training shoes, cycling shoes, football shoes, tennis shoes, soccer shoes, and hiking boots, for example. The concepts may also be applied to footwear types that are generally considered to be non-athletic, including dress shoes, loafers, sandals, and work boots. The concepts disclosed herein apply, therefore, to a wide variety of footwear types.

General Footwear Structure

Figure 1:
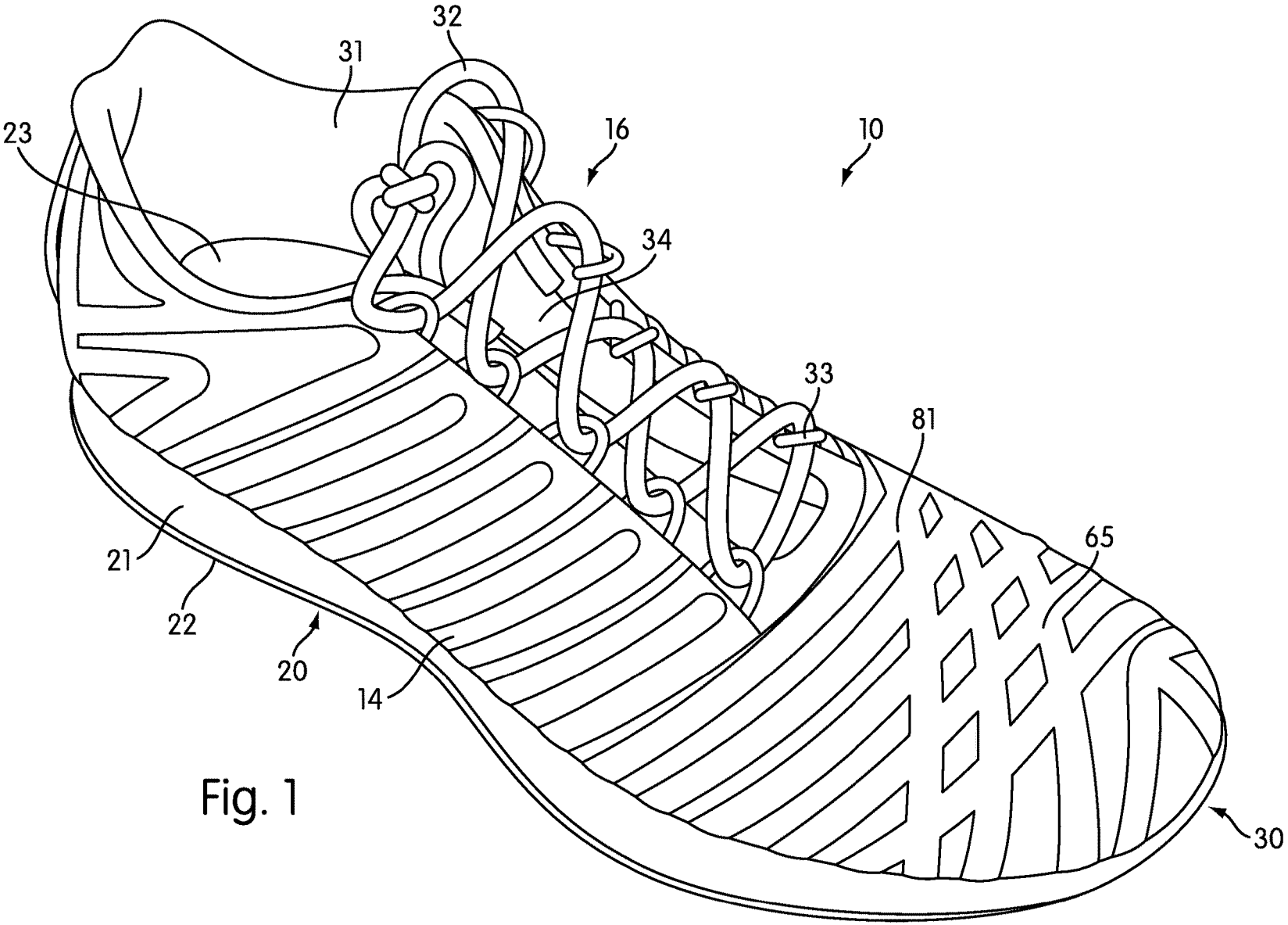
FIG. 1 is a perspective view of an article of footwear.
Figure 2:
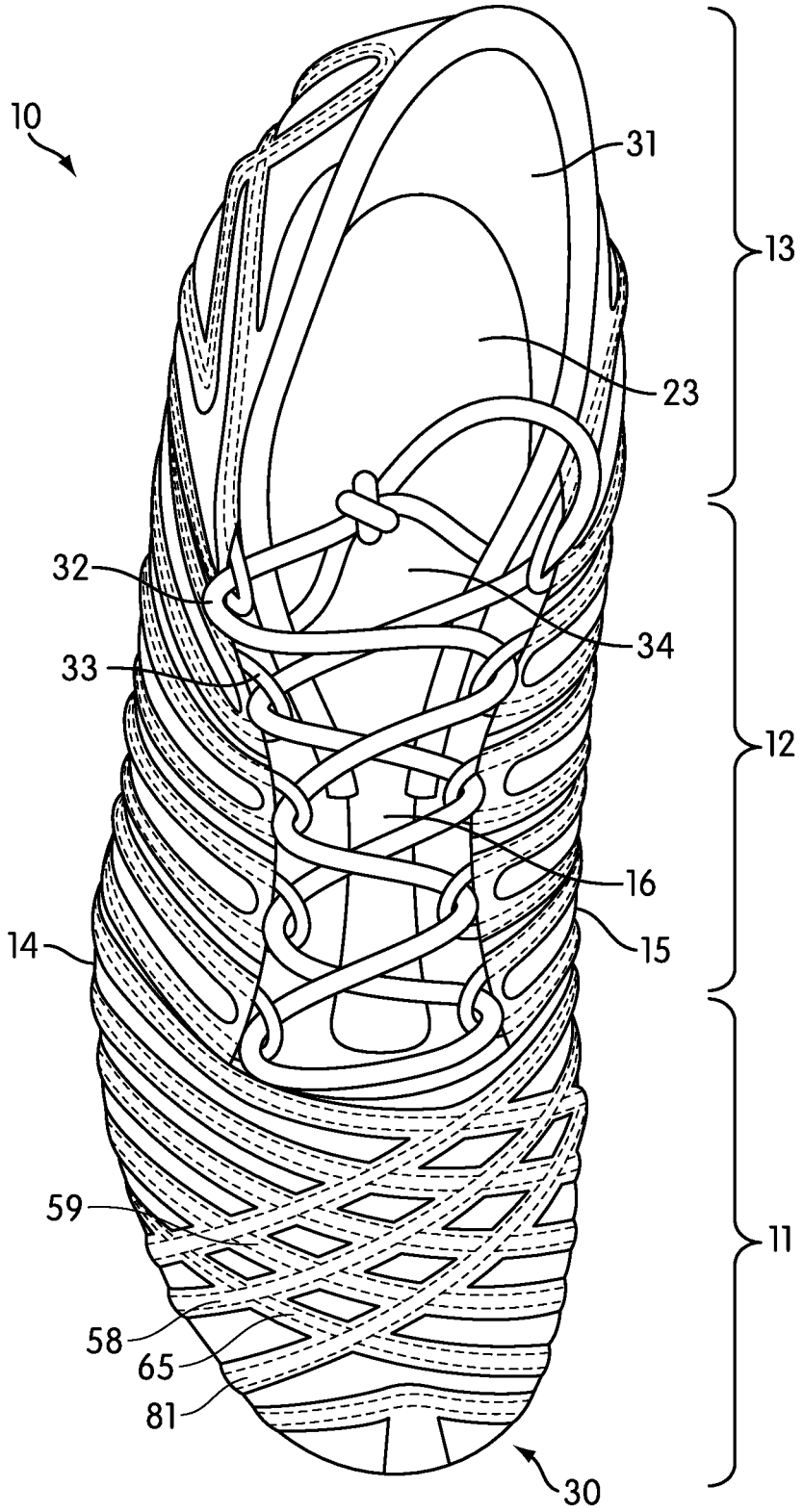
FIG. 2 is a top plan view of the article of footwear.
Figure 3:
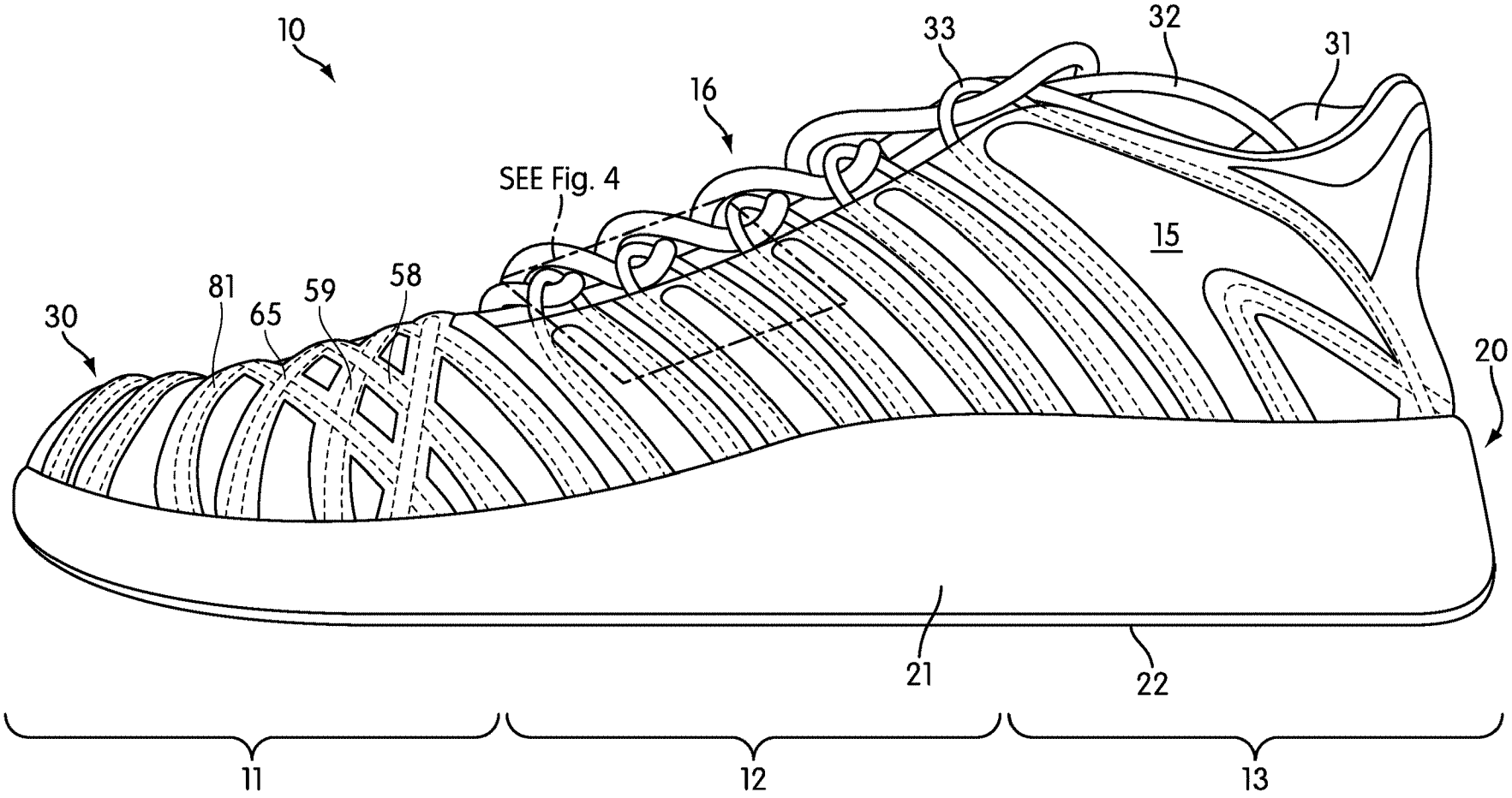
FIG. 3 is a side elevational view of the article of footwear.

An article of footwear 10, herein referred to simply as footwear 10, is depicted in FIGS. 1-3 as including a sole structure 20 and an upper 30. For reference purposes, footwear 10 may be divided into three general regions: a forefoot region 11, a midfoot region 12, and a heel region 13. Footwear 10 also includes a lateral side 14 and a medial side 15. Forefoot region 11 generally includes portions of footwear 10 corresponding with the toes and the joints connecting the metatarsals with the phalanges. Midfoot region 12 generally includes portions of footwear 10 corresponding with the arch area of the foot, and heel region 13 corresponds with rear portions of the foot, including the calcaneus bone. Lateral side 14 and medial side 15 extend through each of forefoot region 11, midfoot region 12, and heel region 13 (as seen in FIG. 3) and correspond with opposite sides of footwear 10 that are separated by a lace region 16, which extends through a length of footwear 10. Forefoot region 11, midfoot region 12, heel region 13, lateral side 14, and medial side 15 are not intended to demarcate precise areas of footwear 10. Rather, they are intended to represent general areas of footwear 10 to aid in the following discussion. In addition to footwear 10, forefoot region 11, midfoot region 12, heel region 13, lateral side 14, and medial side 15 may also be applied to sole structure 20, upper 30, and individual elements thereof.

Sole structure 20 is secured to upper 30 and extends between the foot and the ground when footwear 10 is worn. The primary elements of sole structure 20 are a midsole 21, an outsole 22, and a sockliner 23. Midsole 21 is secured to a lower surface of upper 30 and may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In further configurations, midsole 21 may incorporate fluid-filled chambers, plates, moderators, or other elements that further attenuate forces, enhance stability, or influence the motions of the foot, or midsole 21 may be primarily formed from a fluid-filled chamber. Outsole 22 is secured to a lower surface of midsole 21 and may be formed from a wear-resistant rubber material that is textured to impart traction. Sockliner 23 is located within upper 30 and is positioned to extend under a lower surface of the foot. Although this configuration for sole structure 20 provides an example of a sole structure that may be used in connection with upper 30, a variety of other conventional or nonconventional configurations for sole structure 20 may also be utilized. Accordingly, the structure and features of sole structure 20 or any sole structure utilized with upper 30 may vary considerably.

The various portions of upper 30 may be formed from one or more of a plurality of material elements (e.g., textiles, polymer sheets, foam layers, leather, synthetic leather) that are stitched or bonded together to form a void within footwear 10 for receiving and securing a foot relative to sole structure 20. The void is shaped to accommodate the foot and extends along the lateral side of the foot, along the medial side of the foot, over the foot, around the heel, and under the foot. Access to the void is provided by an ankle opening 31 located in at least heel region 13.

A lace 32 extends through various lace apertures 33 and permits the wearer to modify dimensions of upper 30 to accommodate the proportions of the foot. More particularly, lace 32 permits the wearer to tighten upper 30 around the foot, and lace 32 permits the wearer to loosen upper 30 to facilitate entry and removal of the foot from the void (i.e., through ankle opening 31). As an alternative to lace apertures 33, upper 30 may include other lace-receiving elements, such as loops, eyelets, and D-rings. In addition, upper 30 includes a tongue 34 that extends between ankle opening 31 and lace 32 to enhance the comfort of footwear 10. In some configurations, upper 30 may incorporate a heel counter that limits heel movement in heel region 13 or a wear-resistant toe guard located in forefoot region 11.

In some cases, upper 30 may include a plurality of lace apertures 33, including evenly spaced apertures on lateral side 14 of lace region 16 extending from ankle opening 31 to forefoot region 11. Similarly, upper 30 may include a symmetrical, evenly spaced group of apertures on medial side 14 of lace region 16. Lace 32 may be interwoven though these apertures to provide structural support to upper 30. In some cases, lace apertures may be formed by loops in exposed cord elements from a cord system. Such configurations are discussed in further detail below.

Corded Upper Configuration

Referring to FIGS. 1-3, article of footwear 10 includes provisions for providing structural support across the upper. Generally, article of footwear 10 may include support system 81 that comprises cord system 59 and tunnel system 65. Cord system 59 can include one or more cords that extend throughout portions of upper 30. A cord may be formed from any generally one-dimensional material. As utilized with respect to the present embodiments, the term "one-dimensional material" or variants thereof is intended to encompass generally elongated materials exhibiting a length that is substantially greater than a width and a thickness, such as yarns, cables, threads, ropes, chains, and strands. In one embodiment, cord system 59 includes cord 58. In particular, in the embodiment shown in the Figures, cord system 59 comprises a single cord, rather than multiple cords. However, in other embodiments, more than one cord could be used with cord system 59. In some cases, cord system 59 may be visible through tunnel system 65.

The cord may be formed from a plurality of synthetic materials such as rayon, nylon, polyester, and polyacrylic, cotton, and silk. In addition, the cord may be formed from various engineering fibers, such as aramid fibers, para-aramid fibers, and carbon fibers. Although one-dimensional materials will often have a cross-section where width and thickness are substantially equal (e.g., a round or square cross-section), some one-dimensional materials may have a width that is greater than a thickness (e.g., a rectangular cross-section). Despite the greater width, a material may be considered one-dimensional if a length of the material is substantially greater than a width and a thickness of the material. In different embodiments, the material properties of cord 58 can vary. For example, in some cases, cord 58 can be substantially elastic. In other embodiments, however, cord 58 could be substantially rigid. In different cases, the degree of elasticity or rigidity of cord 58 could be selected according to desired properties for footwear 10.

In some embodiments, support system 81 can include tunnel system 65 that is configured to receive portions of cord 58. Tunnel system 65 generally comprises one or more tunnels disposed on an outer surface of upper 30 through which cord 58 extends. The term "tunnel" as used throughout this detailed description and in the claims refers to any passage, channel, cavity or other similar feature through which a cord can move and that covers at least a portion of the cord. In some embodiments, tunnel system 65 may comprise a single continuous tunnel. In other embodiments, tunnel system 65 may comprise multiple disjoint tunnels. Moreover, tunnel system 65 may comprise multiple tunnels that intersect or otherwise overlap. Tunnels may include passages formed between two layers of upper material defined by stitching or thermal welding, tube-like material attached to upper 30, adhesive tape attached to a layer of upper material, or any other known mechanism.

In some embodiments, tunnel system 65 may be the same color or texture as the rest of upper 30. In other embodiments, tunnel system 65 may be a different color or texture. Moreover, in some cases, tunnel system 65 could be substantially raised from the upper surface of upper 30. In other cases, tunnel system 65 could be substantially flat with respect to an upper surface of upper 30.

Support system 81 (including both cord system 59 and tunnel system 65) can be associated with various portions of upper 30. In some cases, cord system 59 can be associated with forefoot region 11 of upper 30. In other cases, cord system 59 can be associated with midfoot region 12 of upper 30. In still other cases, cord system 59 can be associated with heel region 13 of upper 30. In still other cases, cord system 59 can be associated with multiple different regions of upper 30. In one embodiment, cord system 59 may extend through the substantial entirety of upper 30, including forefoot region 11, midfoot region 12, and heel region 13.

Cord system 59 may be incorporated into lace region 16 of upper 30. In some cases, cord system 59 may comprise a plurality of exposed cord elements located in lace region 16. A cord element is a subsection of cord system 59. To be an exposed cord element, the cord element is configured to be exposed outside the tunnel system. Accordingly, lace 32 may be capable of being interwoven with the exposed cord elements of cord system 59. For example, in the current embodiment, lace apertures 33 comprise exposed cord elements of cord system 59. In such cases, when lace 32 is tightened, cord system 59 may provide additional structural support to upper 30.

In other cases, cord system 59 may comprise exposed cord elements (not shown) located in the sole structure region. In such cases, those exposed cord elements may be disposed along sole structure 20 of article of footwear 10. Such embodiments will be discussed in greater detail in later figures. It will be appreciated that exposed cord elements may exist in other regions of the article of footwear 10, such as heel region 13 and forefoot region 11.

In some cases, cord system 59 and tunnel system 65 may be in one or more variety of patterns. In some embodiments, tunnel system 65 may be configured with a plurality of linear tunnels extending across various portions of upper 30. In other embodiments, tunnel system 65 may be configured with a plurality of curved (or nonlinear) tunnels extending across various portions of upper 30. Moreover, tunnel system 65 may be configured with parallel tunnels or intersecting tunnels. In one embodiment, tunnel system 65 comprises a criss-crossing pattern of tunnels in forefoot region 11 and substantially parallel tunnels in midfoot region 12. Also, in some cases, tunnel system 65 may include straight tunnels that generally extend from lace region 16 to sole structure 20.

Cord 58 may extend through tunnel system 65 in various ways. In the current embodiment, cord 58 may wind through tunnel system 65 in a zigzag (or alternating) manner between lace region 16 and sole structure 20 at midfoot region 12. Likewise, cord 58 may be configured in an intersecting pattern throughout the tunnels of tunnel system 65 disposed in forefoot region 11. It will be appreciated that other patterns or placements of patterns are also possible.

Figure 4:
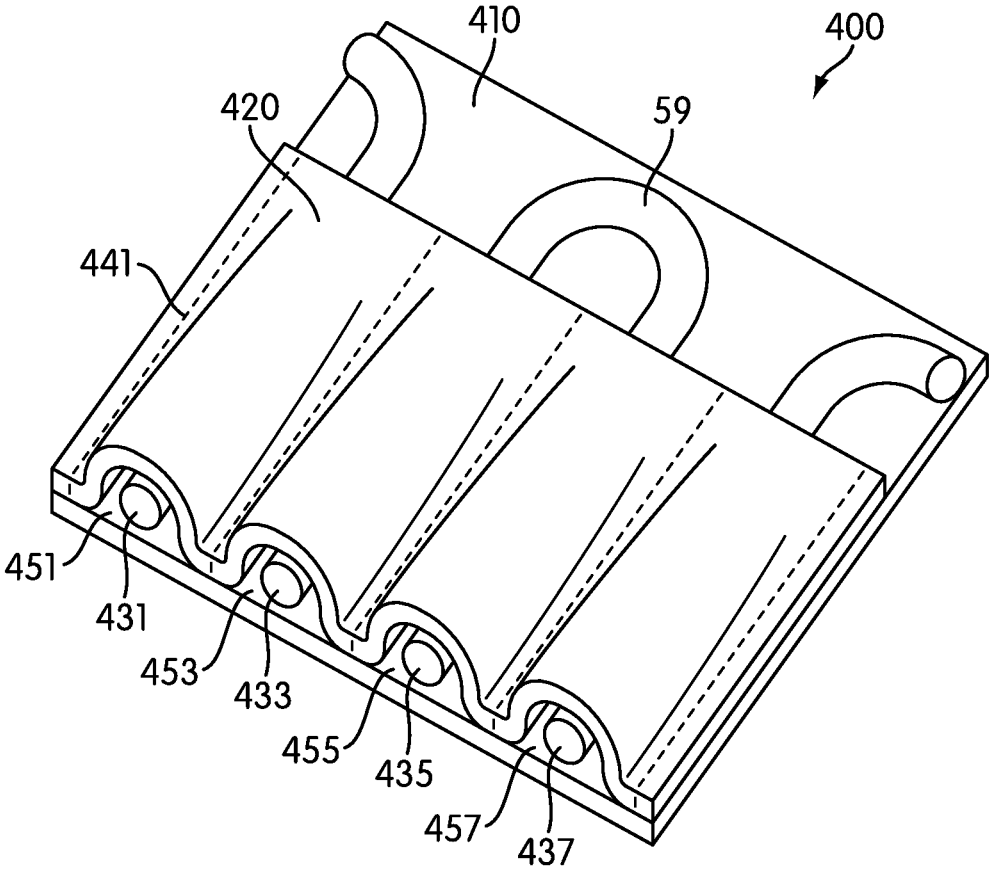
FIG. 4 is a schematic perspective view of a portion of an upper with cord elements, as defined in FIG. 3.
Figure 5:
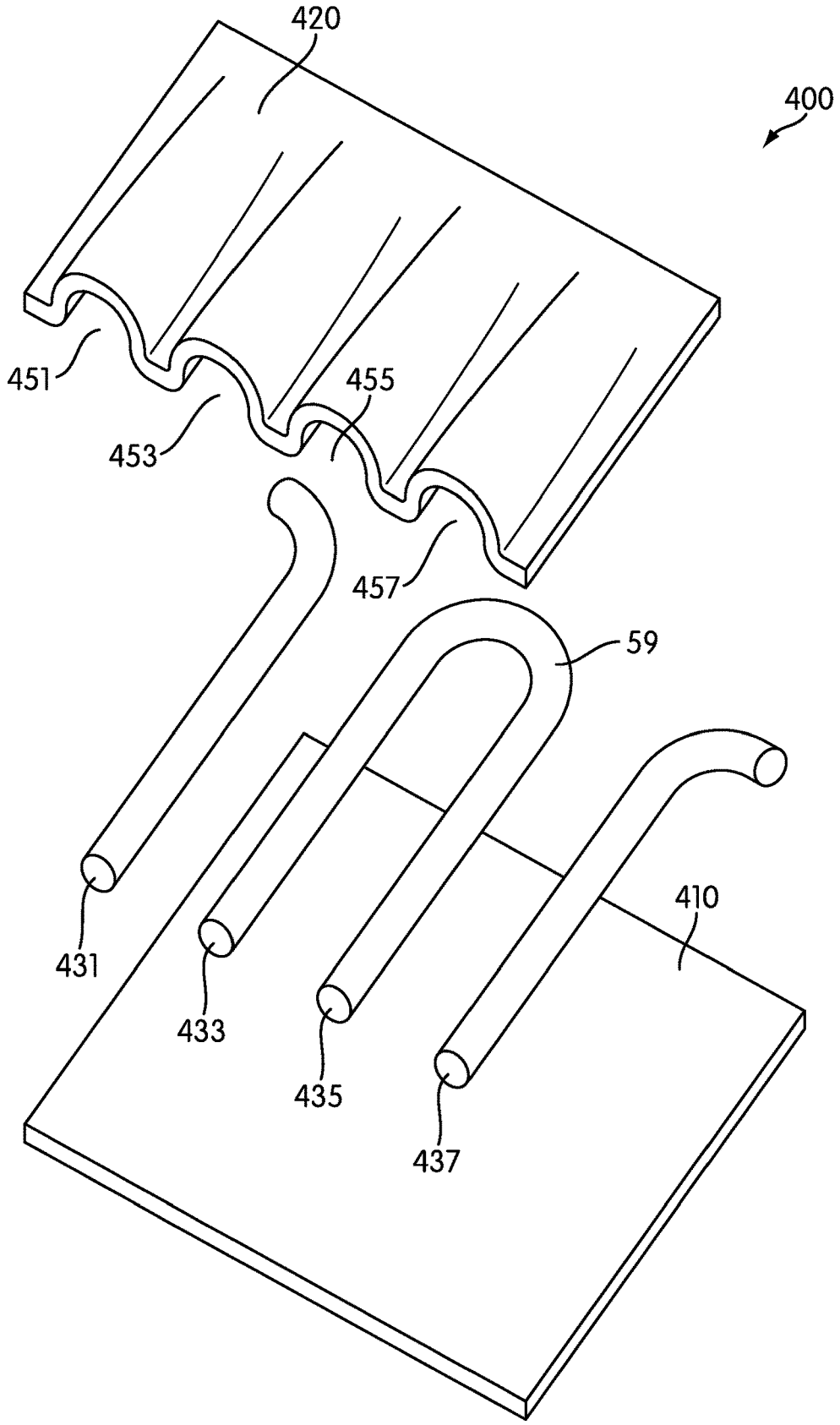
FIG. 5 is an exploded schematic perspective view of the portion of the upper with cord elements.

FIGS. 4 and 5 illustrate embodiments of a segment 400 of upper 30 including multiple cord elements. In particular, FIG. 4 illustrates an enlarged isometric view, while FIG. 5 illustrates an exploded isometric view.

Referring to FIGS. 4 and 5, upper 30 may include provisions for maintaining a system of movable cords within a tunnel system. Generally, upper 30 may comprise at least a first layer 410 and a second layer 420, herein referred to as the upper layers. Upper 30 may also comprise cord element 431, cord element 433, cord element 435, and cord element 437. It will be appreciated that while only four cord elements are shown, the illustration only depicts a subsection of upper 30. Accordingly, there may be a greater number of cord elements. Cord element 431, cord element 433, cord element 435, and cord element 437 may each be an element of the same cord or different cords within a system of cords. All cords within upper 30 will herein be referred to as cord system 59.

First layer 410 and second layer 420 can be of any material or mixed materials, including but not limited to various textiles (woven, knitted, and non-woven) canvas, leather, or vinyl. In some embodiments, second layer 420 may be made of the same material as first layer 410. In other embodiments, second layer 420 may be made of a different material or a mixture of materials.

Upper 30 may also comprise stitching 441 to secure second layer 420 to first layer 410. Stitching 441 may comprise a thread that may be made of any material including, but not limited to, cotton, silk, and polyester. In some cases, the upper layers may be stitched together so as to form tunnel 451, tunnel 453, tunnel 455, and tunnel 457. Other tunnels of upper 30 may not be shown. All tunnels of upper 30 are herein referred to as the tunnel system. The cord system 59 may be disposed inside of the plurality of tunnels so they may move freely in multiple directions. It will be appreciated that while only a section of upper 30 is shown, these features may apply to any section of upper 30. It should be noted that stitching 441 may be replaced by any other method or structure for securing layers 410 and 420, including adhesive bonding, thermal bonding, tacking, stapling, and pinning, for example.

Figure 6:
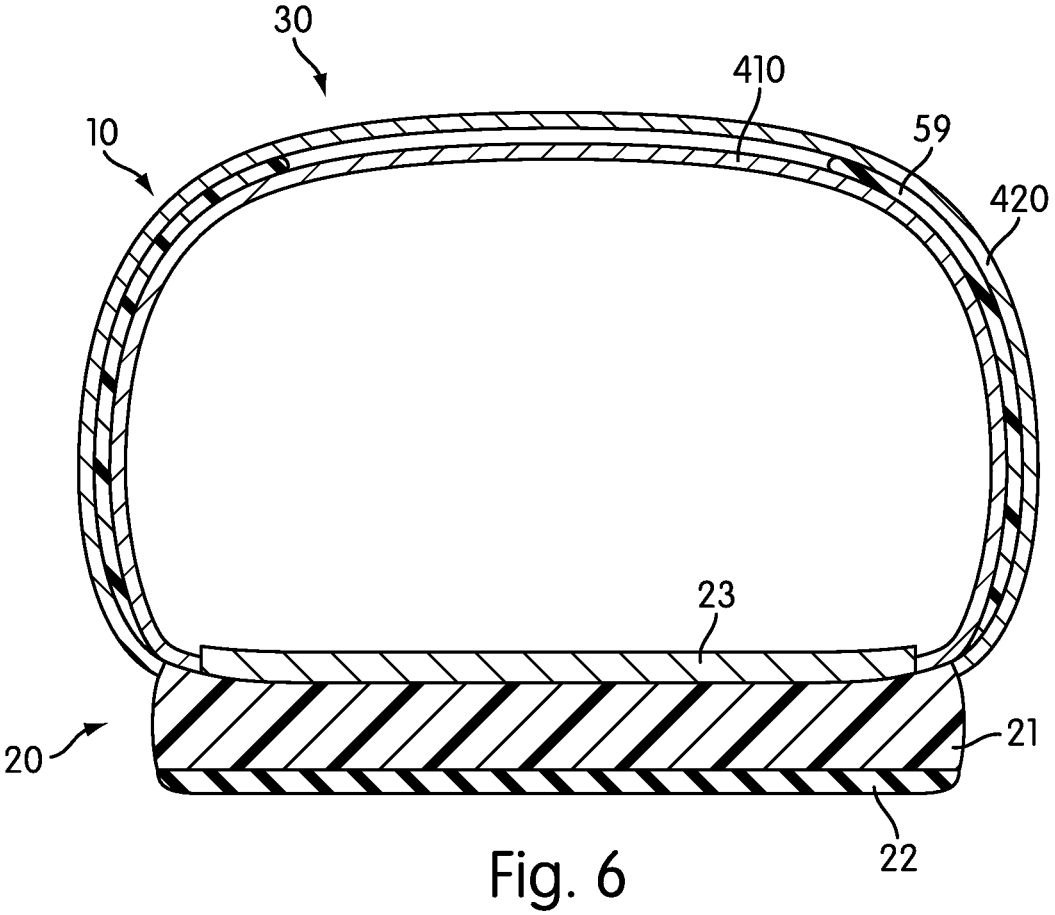
FIG. 6 is a cross-sectional view of an embodiment of an article of footwear.
Figure 7:
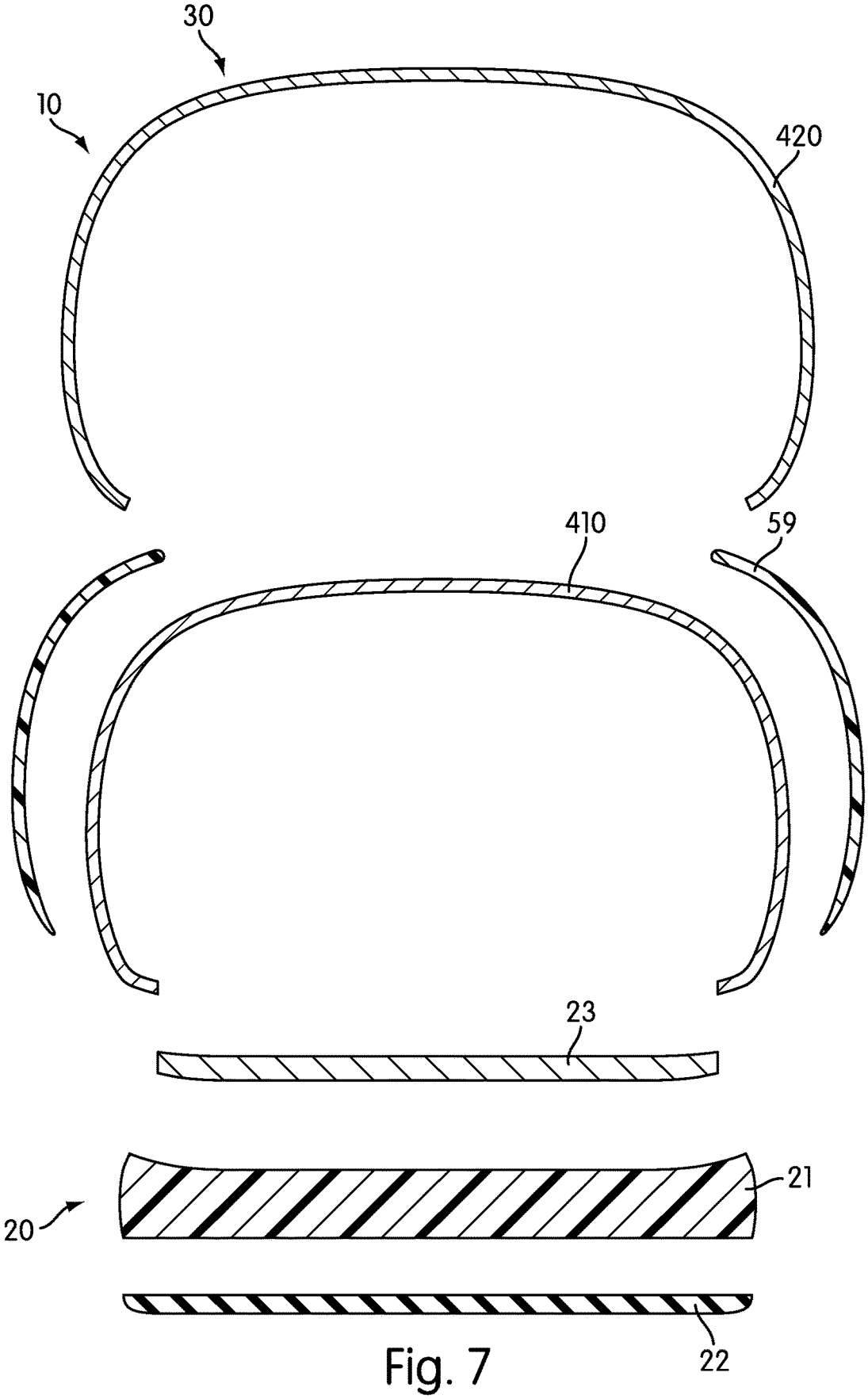
FIG. 7 is an exploded cross-sectional view of the embodiment of the article of footwear depicted in FIG. 6.

As seen in FIG. 5, without stitching 441 connecting the upper layers, the second layer 420 and first layer 410 may be physically separated. Similarly, cord system 59 may be physically separated from the upper layers. FIGS. 6 and 7 show a cross-sectional view and exploded cross-sectional view of article of footwear 10. Generally, article of footwear 10 may comprise sole structure 20. Sole structure 20 may comprise outsole 22, midsole 21, and sockliner 23. It will be appreciated that some illustrated elements of sole structure 20 may be optional. Alternatively, sole structure 20 may comprise additional layers (not shown).

Article of footwear 10 may also comprise upper 30. Upper 30 may comprise second layer 420, cord system 59, and first layer 410. Cord system 59 may be disposed between second layer 420 and first layer 410. In some cases, cord system 59 may extend only as far as the bottom portion of upper 30. However, in other embodiments, cord system 59 may extend to midsole 21 or outsole 22. Such embodiments will be described in detail in later figures. It will be appreciated that some illustrated elements of upper 30 may be optional. Alternatively, other additional elements may be included. For example, upper 30 may comprise additional fabric layers (not shown).

Manufacturing Method

A method for making an article with a support system can include provisions for efficiently assembling an upper including a cord system and a tunnel system. FIGS. 8 through 18 illustrate embodiments of a method of manufacturing an upper for an article of footwear including a support system.

Figure 8:
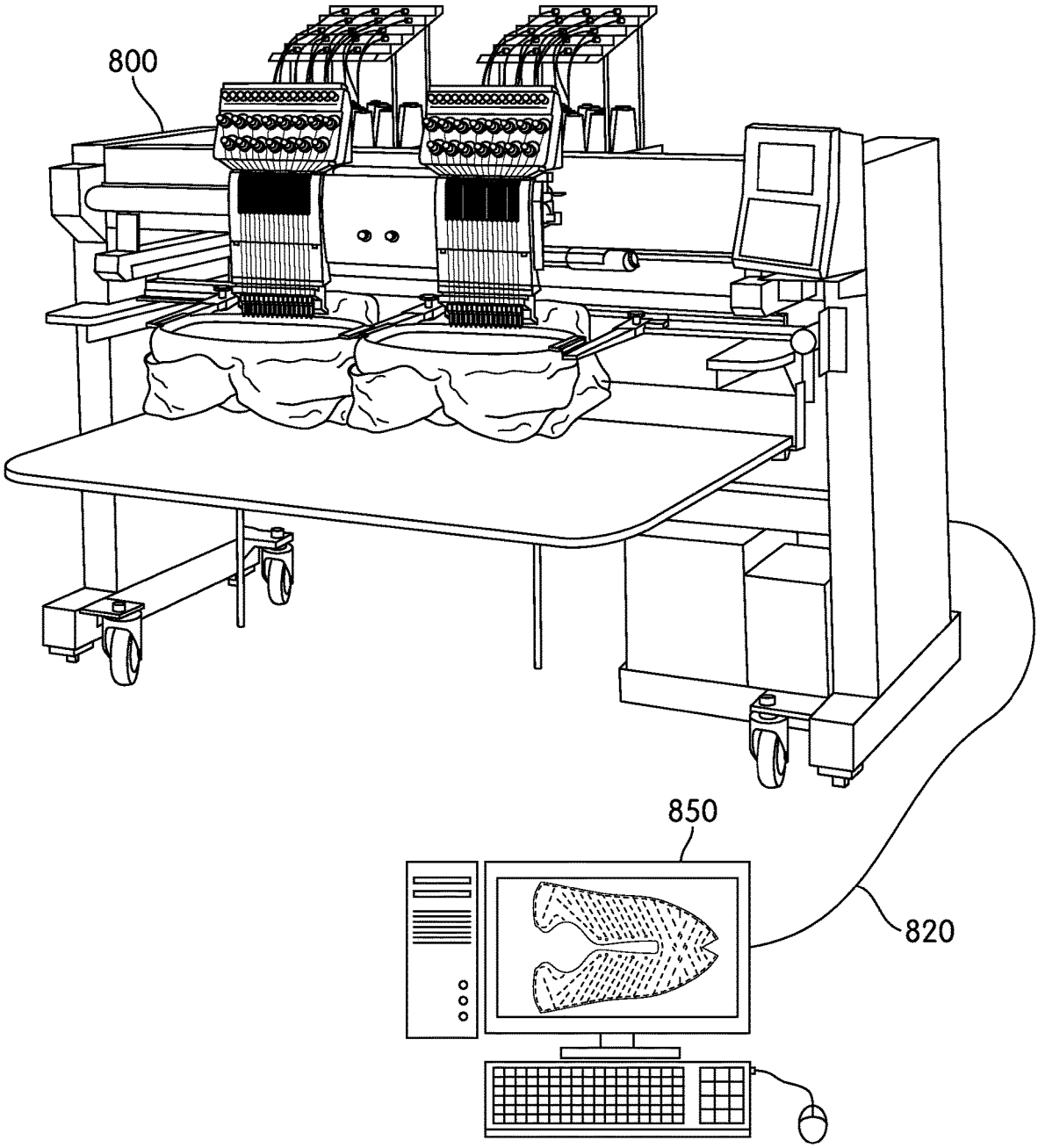
FIG. 8 is a perspective view of an embroidery machine used for manufacturing in some footwear upper configurations.

FIG. 8 shows an embodiment of an embroidery machine 800. In some cases, one or more steps of the manufacturing process may use embroidery machine. In other embodiments, many or all steps may be completed by hand. When embroidery machine 800 is used, placement patterns for the cord system may be easier, such as hairpin turns.

Embroidery machine 800 may include provisions for generating and controlling embroidery patterns. In some cases, embroidery machine 800 may be controlled manually. In other cases, embroidery machine 800 may be controlled by a computer system. The computer system may be located on embroidery machine 800. However, in other embodiments, separate computer system 850 may control the actions of embroidery machine 800. Computer system 850 may include connection 820 to embroidery machine 800. While connection 820 is shown, it will be appreciated that computer system 850 may communicate with embroidery machine 800 through any known means, including using some form of wireless communication.

Computer 850 may be any type of personal computer, commercial computer, or use-specific computer. Generally, computer system 850 is controlled by a central processing unit. The central processing unit may be a general purpose processor, a digital signal processor or any other type of processor. Computer system 850 may also comprise other auxiliary elements, including but not limited to: a monitor, a mouse, a keyboard, a hard drive or solid state drive.

A proprietor may use embroidery machine 800 in conjunction with computer system 850 to design and/or create an upper including a support system such as the support system described above. For example, in some cases a proprietor could use computer system 850 to design or import an existing design for a predetermined pattern associated with a tunnel system and cord system. The design may be processed and submitted as instructions to control embroidery machine 800 to stitch together various layers of an upper as well as one or more cords in the manner discussed below.

Figure 9:
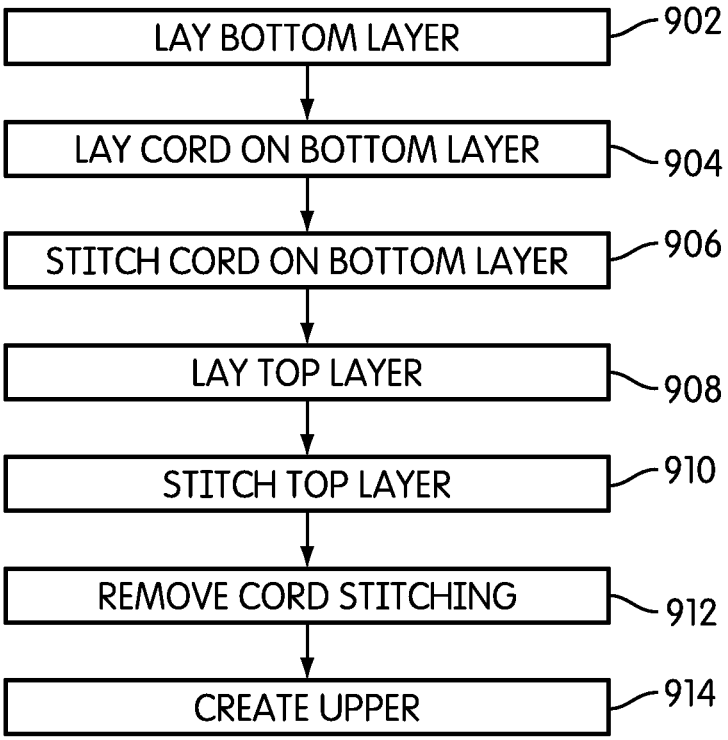
FIG. 9 shows an example of a process for manufacturing an article of footwear.

FIG. 9 shows an embodiment of a process for manufacturing an article of footwear. Some or all steps in the process may be completed by a footwear manufacturer or proprietor. In other cases, some steps could be accomplished by a manufacturer and other steps could be accomplished by another party including another manufacturer, proprietor, retailer or any other entity. In some cases, one or more of the steps may be optional. In other cases, some steps may be completed in a different order.

In step 902, a first layer may be placed on a working surface. In some embodiments, the first layer may have been pre-cut into the intended shape of the completed upper. As described in the embodiments below, the upper has not been pre-cut. In some cases, the first layer may be placed on any substantially flat surface. In other cases, the first layer may be placed in an embroidery machine, such as embroidery machine 800 (see FIG. 8).

In step 904, a cord system may be placed on the first layer. The cord system may comprise one or more cords and may be placed in any configuration. In some cases, the cord system may be placed to provide cord elements along a lacing region. In some cases, a computer program and embroidery machine may facilitate placing the cord system in a desired pattern. The computer program and embroidery machine may be capable of placing the cord system with consistent precision, allowing an accurate cord length to be provided in this step. The computer program and embroidery machine may also facilitate certain patterns that are difficult to perform by hand, such as hairpin turns or other complex patterns.

In step 906, the cord system may be stitched or otherwise secured to the first layer using a first thread. Generally, the cord system is stitched so that it may not be moved in any direction relative to the first layer. The stitching may be completed by hand, by embroidery machine 800 or by any other process. In some cases, the first thread may be specially colored to facilitate later removal. In some cases, the type of stitching used in securing the cord system to the first layer can be selected so that the stitching is relatively easy to remove at a later time. For example, the stitching may be water-soluble or soluble with other chemicals so that the stitching is relatively easy to remove at a later time. It should be noted that stitching is only an example of a method of securing the cord system to the first layer, with other examples being adhesive bonding, thermal bonding, tacking, stapling, and pinning, for example.

In step 908, the second layer may be placed on the first layer. In some cases, the second layer may be pre-cut into the shape of a completed upper; however, as illustrated, the second layer may not be pre-cut. If pre-cut, the second layer may be placed on the first layer so that the edges align. In other embodiments, the second layer shape and the first layer shape may differ. Accordingly, the cord system may be disposed between the second layer and the first layer.

In step 910, the second layer may be stitched onto the first layer using a second thread. Generally, the stitching may be completed to form tunnels surrounding each cord element. In some cases, the tunnels may be configured so the tunnels fit snuggly around each cord element. In other cases, the tunnels may be configured to fit more loosely around each cord element.

In some embodiments, the first thread may be different than the second thread. In particular, the first thread may be designed to be a less permanent stitching than the second thread. In some cases, the first thread may be designed to be easily removed by cutting. In other cases, the first thread may be designed to be dissolved in water or another solution. Moreover, as discussed in detail below, in some cases, the second layer may be connected to the first layer by means other than stitching. In some cases, the second layer can be thermally welded to the first layer.

In step 912, the first stitching with the first thread may be removed. More generally, the cord system is detached from the first layer. The thread used to stitch the cord system to the first layer may be removed. After this stitching is removed, the cord system may be allowed to move freely within the confines of the tunnels created by the second stitching with the second thread. The first thread may be removed by any known method, including but not limited to: cutting away the first thread or dissolving the first thread in water or another solution.

In step 914, the combined first layer, cord system, and second layer may be used to form an upper. The upper may be formed using any known technique and subsequently added to a sole structure to form a completed article of footwear. It will be appreciated that the upper may be created using additional layers, cords or stitching not expressly mentioned.

Figure 10:
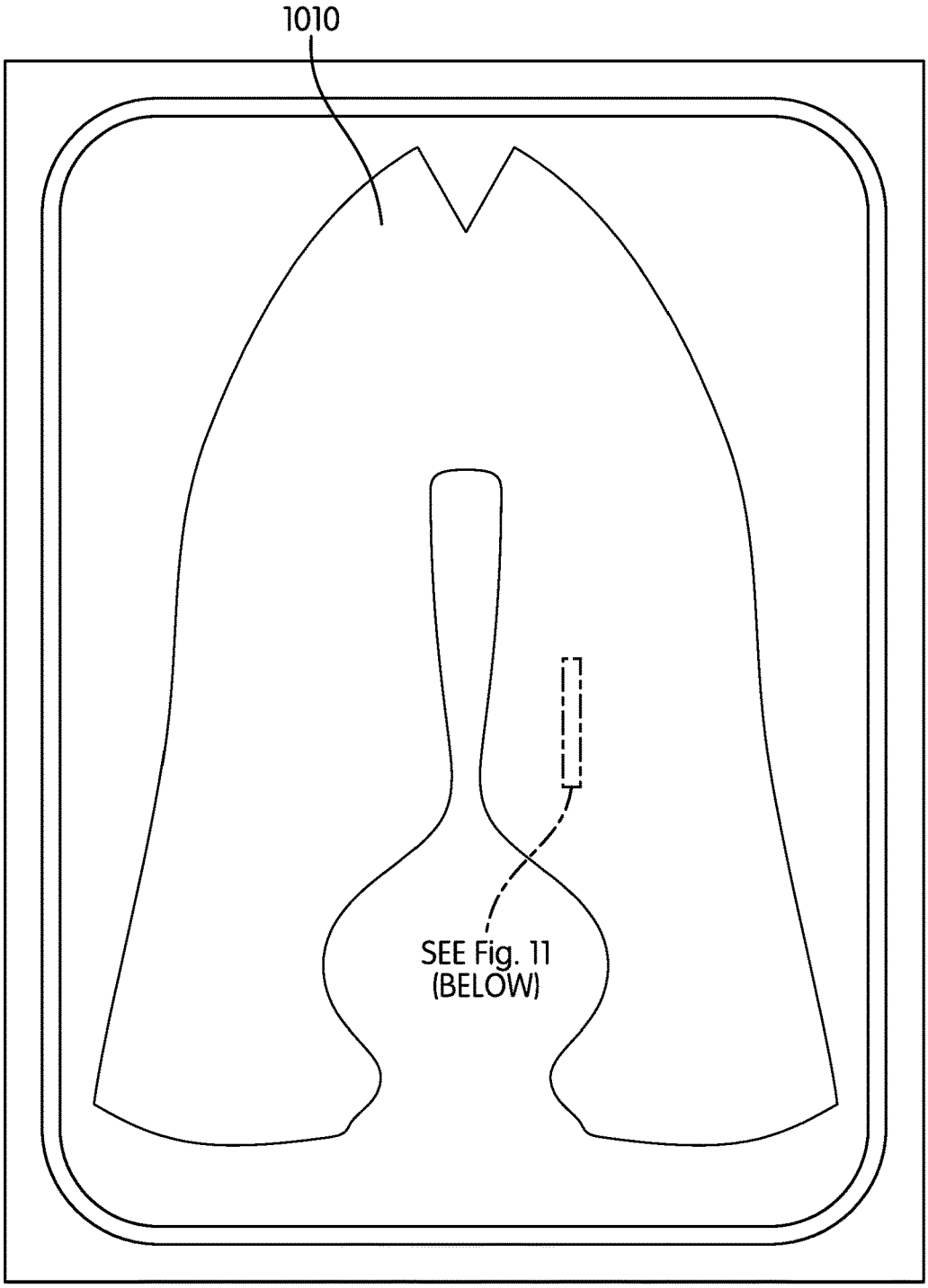
FIGS. 10 and 11 depict a top plan view and cross-sectional view of an embodiment of a partially formed an article of footwear.
Figure 11:
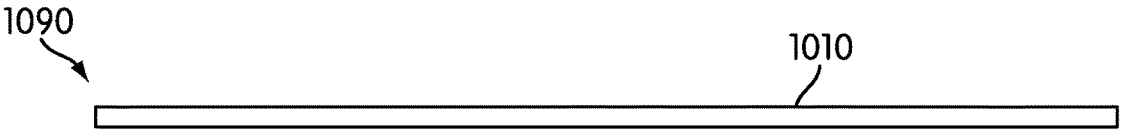

FIGS. 10-11 show a schematic and cross-sectional view of a partially formed article of footwear. In particular, the illustration refers to step 902 of FIG. 9 and shows a schematic view of bottom later 1010 as well as a cross-sectional view of portion 1090 of first layer 1010. Accordingly, first layer 1010 may be placed down on a working surface of some kind. In some cases, first layer 1010 may be of substantially even thickness, as shown in the cross-sectional view of portion 1090. In some cases, first layer 1010 may be placed on a flat surface. In other cases, first layer 1010 may be placed on a curved surface. In one embodiment, first layer 1010 may be placed on a surface of an embroidery machine, such as embroidery machine 800. While first layer 1010, as illustrated, has not been cut into the shape of an upper, in other embodiments, a step may occur prior to step 902. In some cases, when uncut, the outline of the upper may be provided on first layer 1010 so that it may be visible to the manufacturer.

Figure 12:
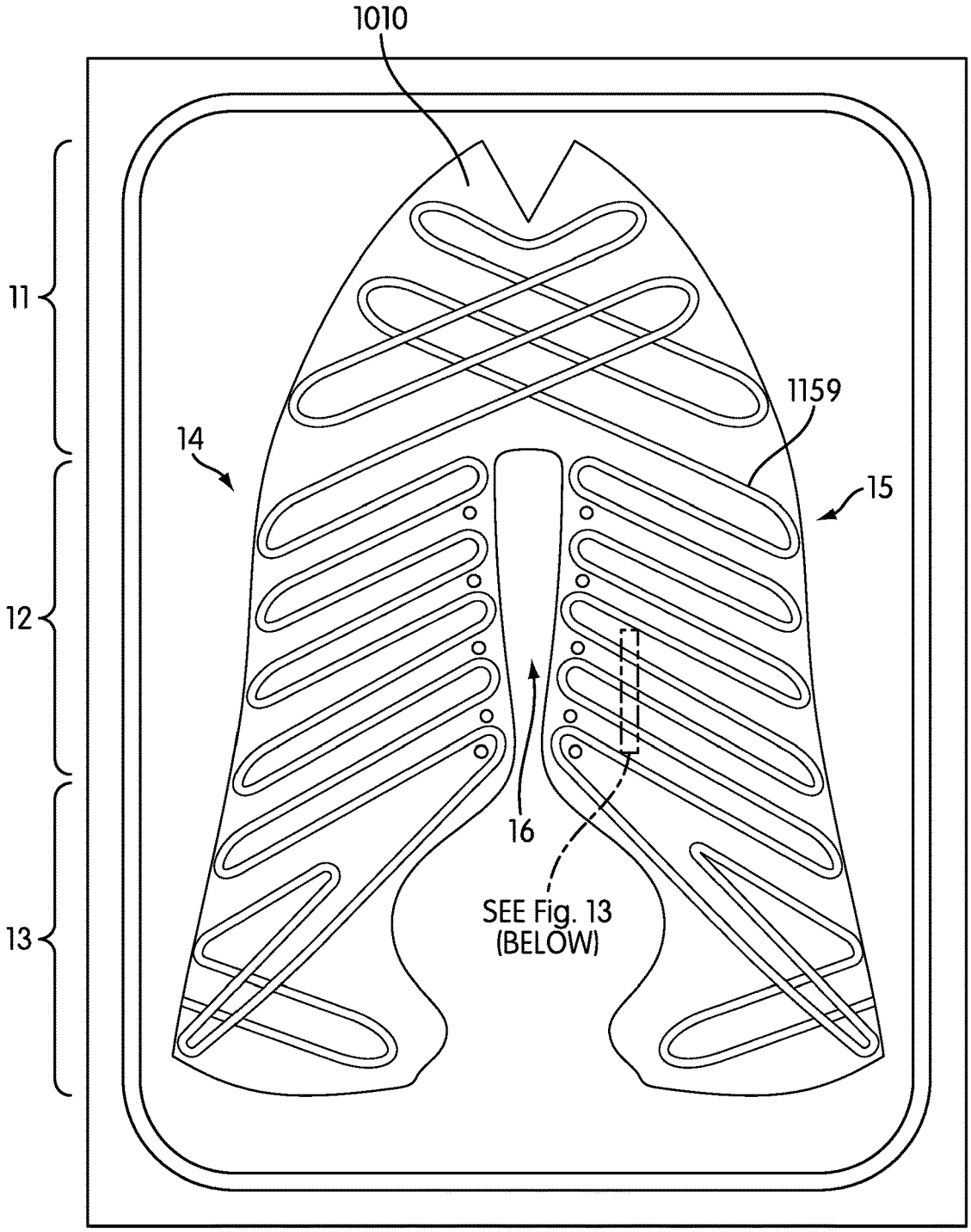
FIGS. 12 and 13 depict another top plan view and cross-sectional view of an embodiment of a partially formed article of footwear.
Figure 13:
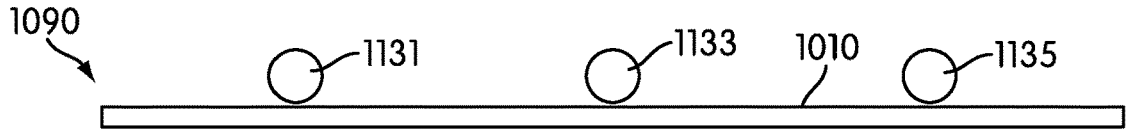

FIGS. 12-13 show another schematic and cross-sectional view of a partially formed article of footwear. In particular, the illustration refers to step 904 of FIG. 9 and shows a schematic view of first layer 1010 and a cross-sectional view of portion 1090. Accordingly, cord system 1159 may be placed upon first layer 1010. Cord system 1159 may be comprised of one or more cords and may comprise a plurality of cord elements, including cord element 1131, cord element 1133, and cord element 1135. In the current embodiment, cord element 1131, cord element 1133, and cord element 1135 comprise portions of cord system 1159.

As shown in the cross-sectional view of portion 1090, cord element 1131, cord element 1133, and cord element 1135 may have a substantially circular cross-section. It will be appreciated that cord element 1131, cord element 1133, and cord element 1135 may have any cross-sectional shape including, but not limited to: rounded, triangular, rectangular, flattened, polygonal, regular, irregular or any other kind of cross-sectional shape.

Cord system 1159 may be placed in any configuration. As illustrated, cord system 1159 may comprise several cord elements crossed in forefoot portion 11. Similarly, both medial side 15 and lateral side 14 of the midfoot portion 12 may comprise cord elements in an approximately zigzagging pattern. In some cases, cord system 1159 may be configured so that some portions of the cord elements are arranged near a lace region 16. In other cases, cord elements may be configured to be attached to portions of the sole structure (not shown). Such embodiments will be shown in greater detail in later figures.

Figure 14:
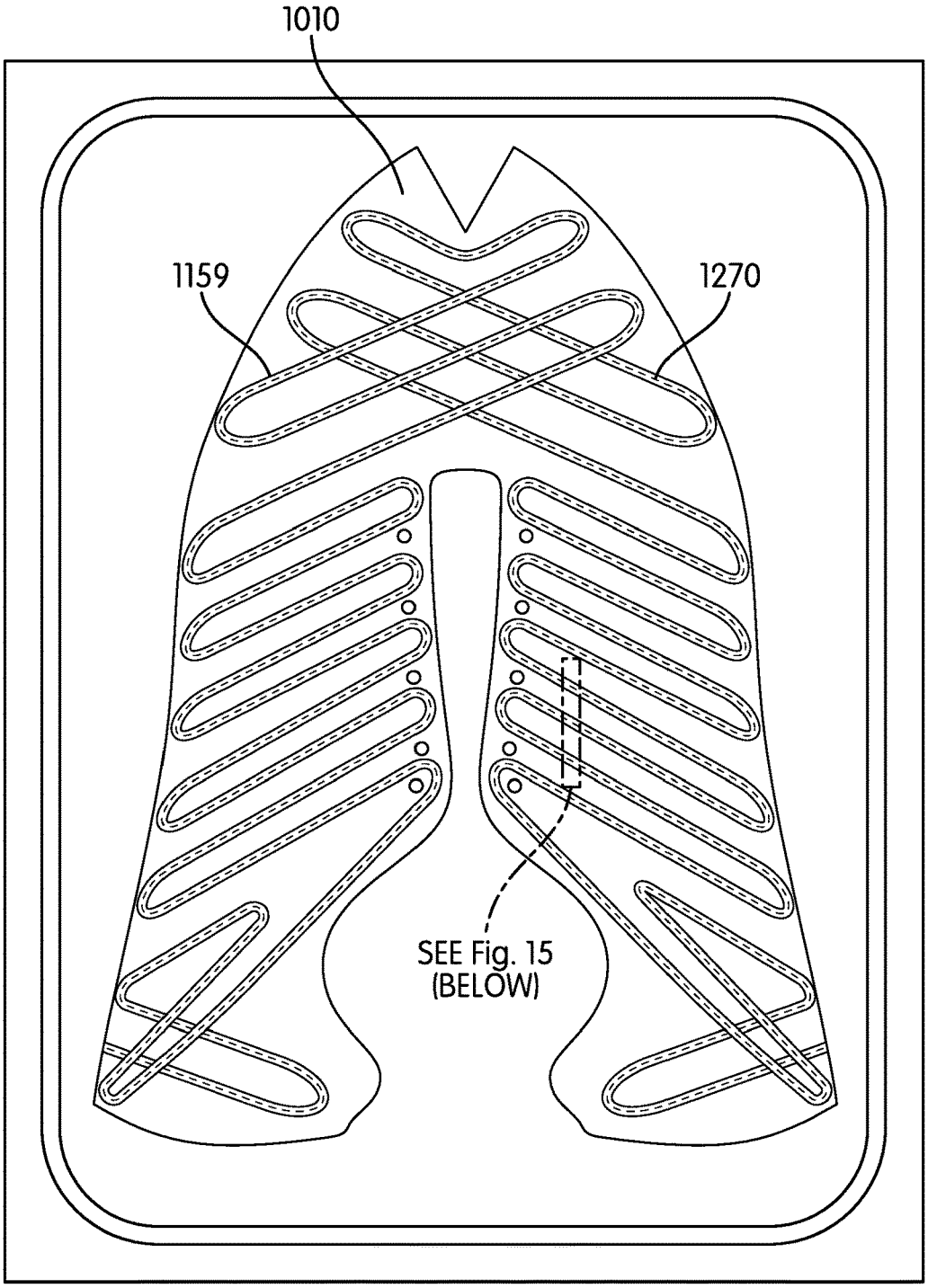
FIGS. 14 and 15 depict another top plan view and cross-sectional view of an embodiment of a partially formed article of footwear.
Figure 15:
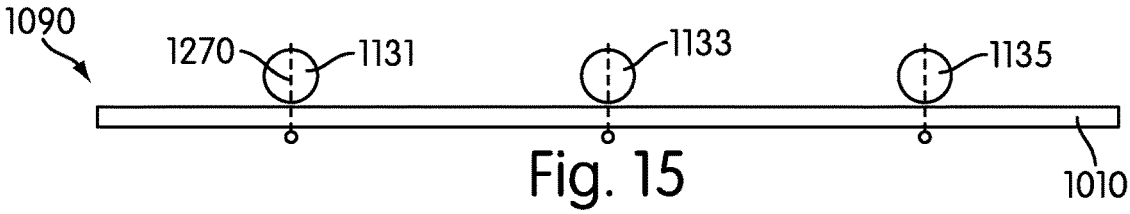

FIGS. 14-15 show another schematic and cross-sectional view of a partially formed article of footwear. In particular, the illustrations refer to step 906 of FIG. 9 and show a schematic view of first layer 1010 and cord system 1159 and a cross-sectional view of portion 1090. Accordingly, cord system 1159 may be secured in place using first thread 1270. In particular, first thread 1270 is used to stitch cord system 1159 to first layer 1010. In some cases, first thread 1270 may be stitched along the entire length of cord system 1159. In other cases, first thread 1270 may be stitched along some portions of cord system 1159, but not others. In different embodiments, first thread 1270 could be made of varying materials. In some embodiments, first thread 1270 may be made of any material including, but not limited to: cotton, silk, and polyester. In other embodiments, any other materials known in the art could be used. As suggested above, stitching with first thread 1270 is only an example of a method of securing cord system 1159 to first layer 1010, with other examples being adhesive bonding, thermal bonding, tacking, stapling, and pinning, for example.

Once stitched, cord system 1159 may be limited to little or no movement with respect to first layer 1010. First thread 1270 may also be designed to be easily removed by any known method including, but not limited to: cutting or dissolving in water or another solution. In some cases, the type of stitching used to secure first thread 1270 to first layer 1010 may be selected to facilitate easy removal of first thread 1270 from cord system 1159 and first layer 1010.

Figure 16:
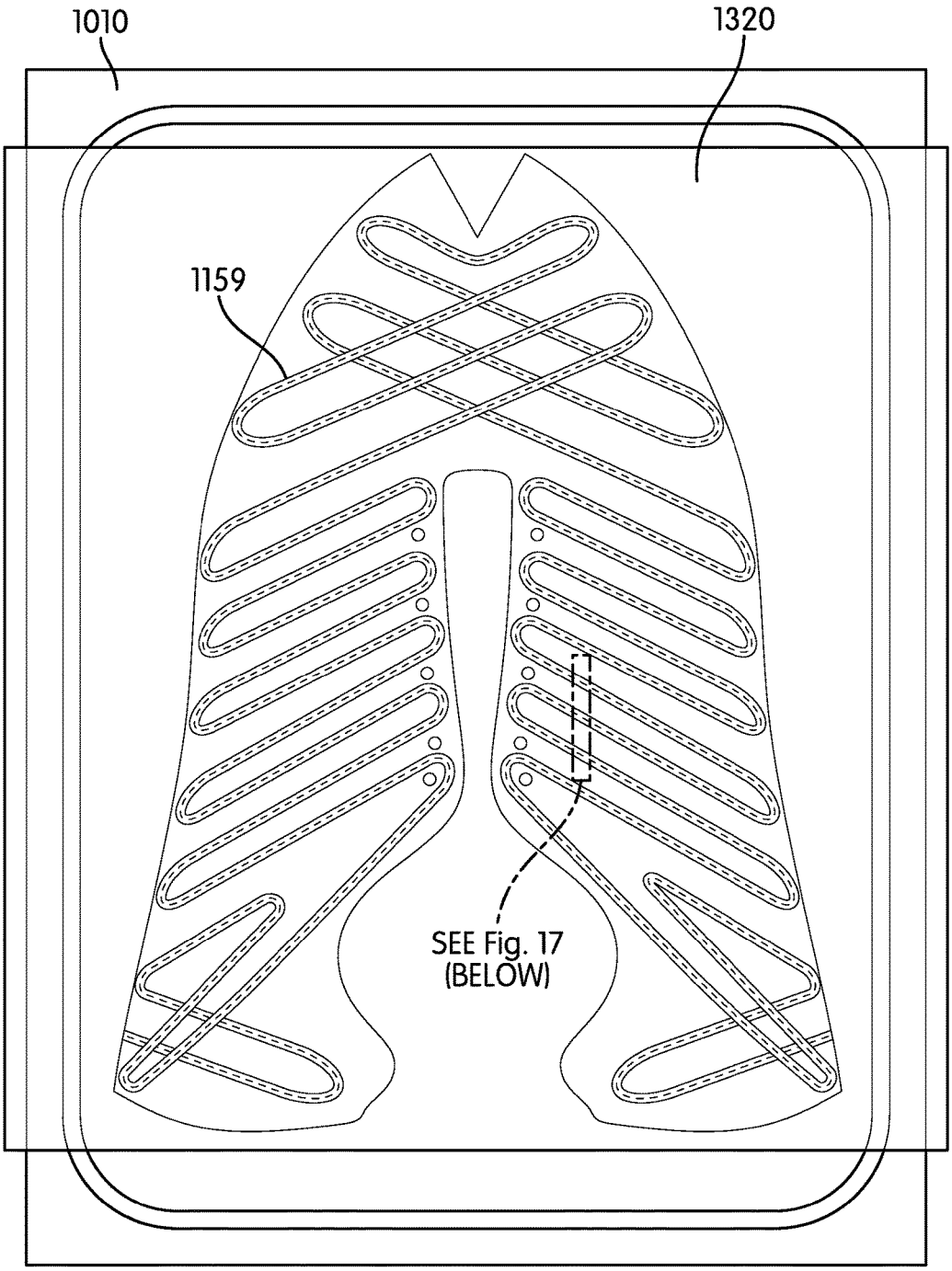
FIGS. 16 and 17 depict another top plan view and cross-sectional view of an embodiment of a partially formed article of footwear.
Figure 17:
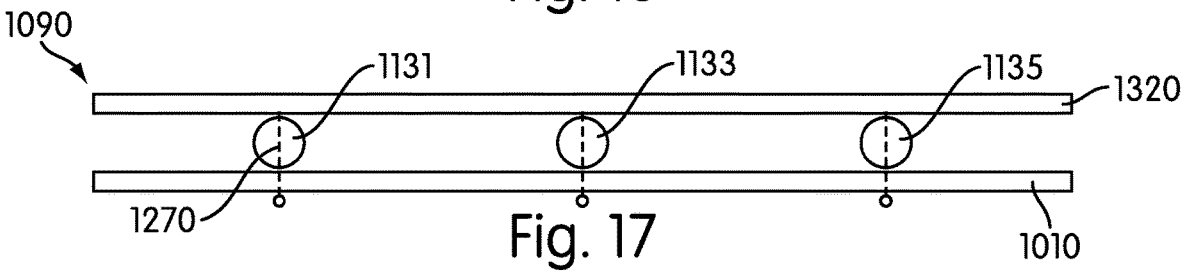

FIGS. 16-17 show another schematic and cross-sectional view of a partially formed article of footwear. In particular, the illustrations refer to step 908 of FIG. 9 and show a schematic view of first layer 1010 and cord system 1159 and a cross-sectional view of portion 1090. Accordingly, second layer 1320 may be placed on first layer 1010 and cord system 1159. In some cases, second layer 1320 may be pre-cut into the form of an upper. As illustrated, second layer 1320 has not been pre-cut. Accordingly, a visible outline may be made on second layer 1320 to form the shape of the completed upper. If appropriate, the edges of second layer 1320 may be aligned with first layer 1010. In some embodiments, first layer 1010 and cord system 1159 will not be visible through second layer 1320. However, both first layer 1010 and cord system 1159 are visible for illustrative purposes.

Figure 18:
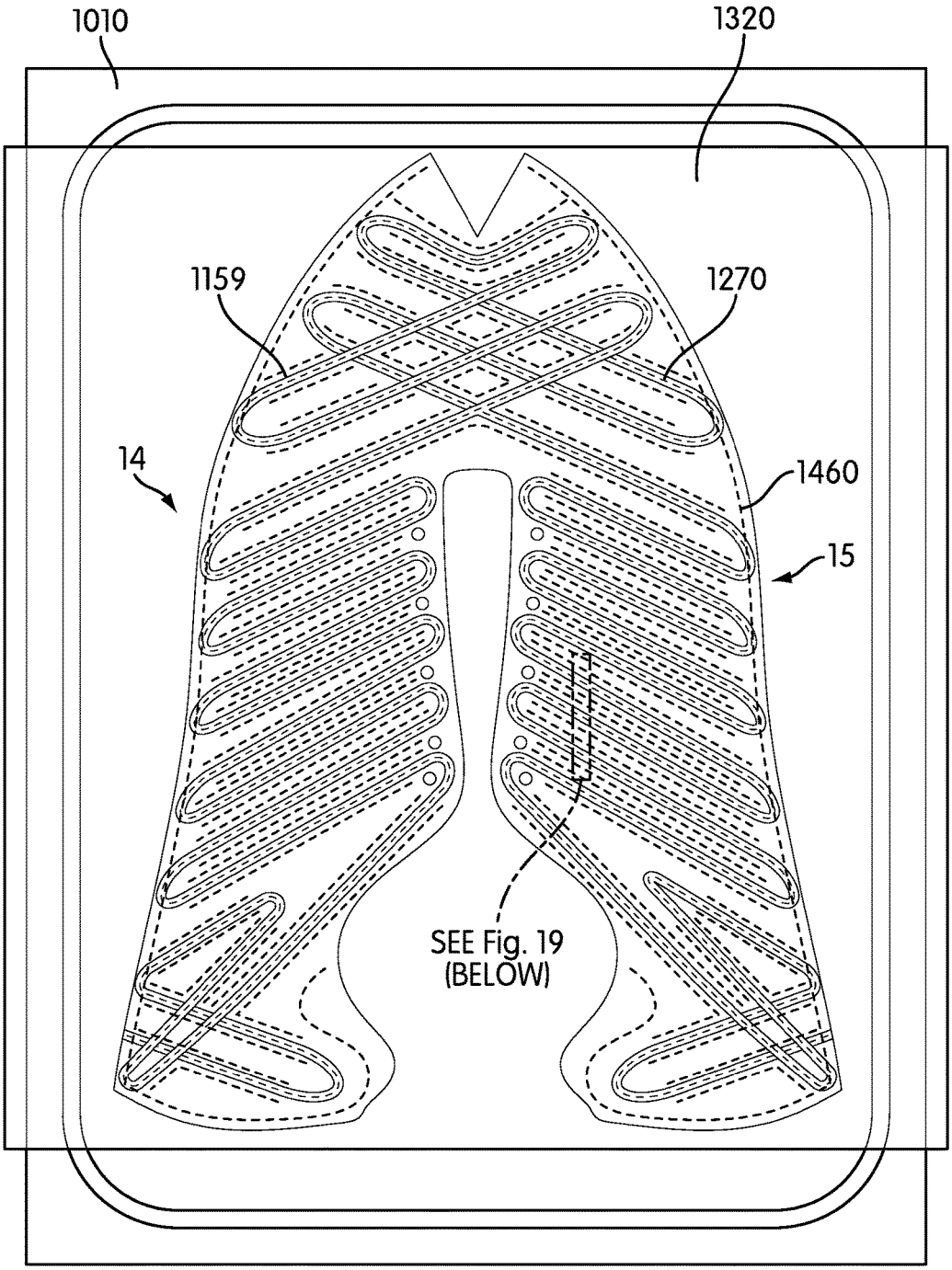
FIGS. 18 and 19 depict another top plan view and cross-sectional view of an embodiment of a partially formed article of footwear.
Figure 19:
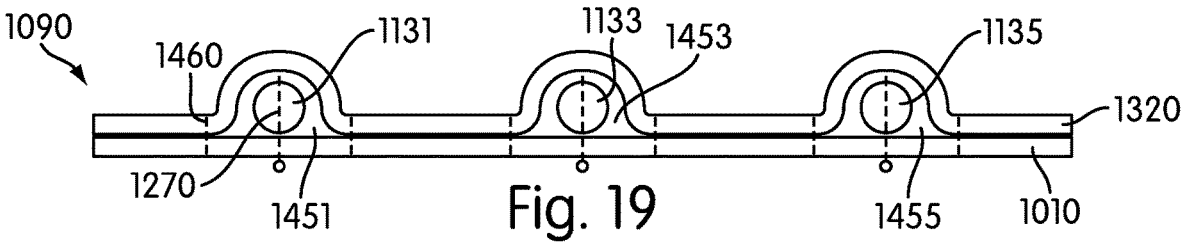

FIGS. 18-19 show another schematic and cross-sectional view of a partially formed article of footwear. In particular, the illustrations refer to step 910 of FIG. 9 and show a schematic view of first layer 1010, cord system 1159, and second layer 1320 and a cross-sectional view of portion 1090. Accordingly, second layer 1320 may be secured to first layer 1010. In some cases, the securing is completed by stitching with second thread 1460. In other cases, the securing may be completed by thermal welding. If stitched, second thread 1460 may be configured to form a tunnel system for receiving various cord elements. As illustrated the tunnel system comprises tunnel 1451, tunnel 1453, and tunnel 1455. In some cases, the tunnel system may be configured to fit snuggly upon cord system 1159. In other cases, the tunnel system may be more loosely fit. In some embodiments, second layer 1320 may be designed to be substantially clear, allowing cord system 1159 to be visible through second layer 1320. In other embodiments, second layer 1320 may be opaque.

In some embodiments, stitching from second thread 1460 may also form a perimeter along the edges of the upper for second layer 1320 and first layer 1010. In such cases, second thread 1460 may be configured to stitch portions of cord system 1159 to the upper, for example along the parameter of the upper. Accordingly, second thread 1460 may restrict the movement of cord system 1159. In other cases, second thread 1460 may not be configured to bind cord system 1159. In still other cases, second thread 1460 may not be used at all in some perimeter portions, such as the lateral side 14 or the medial side 15. Accordingly, cord elements of cord system 1159 may be capable of being exposed outside of an upper.

Figure 20:
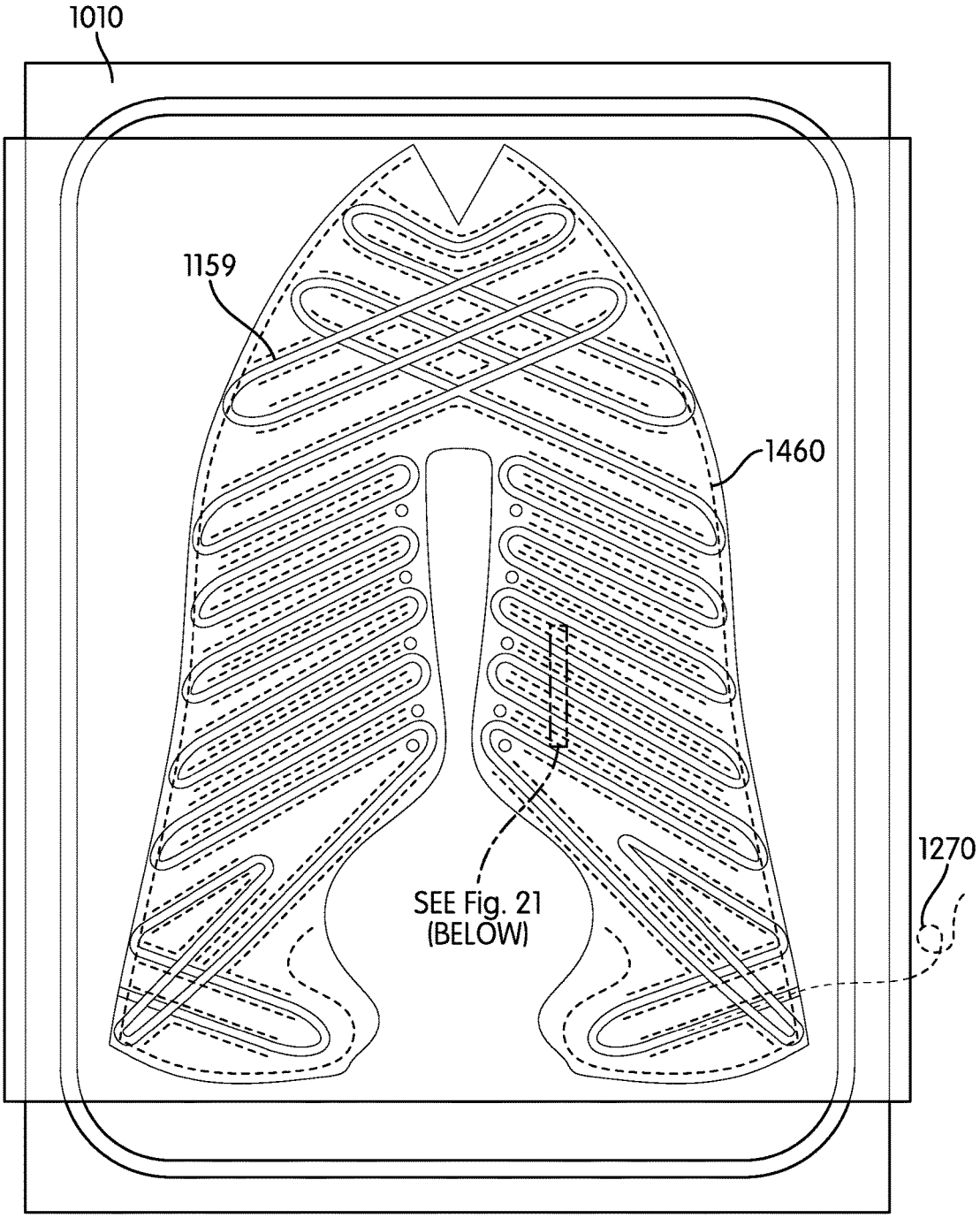
FIGS. 20 and 21 depict another top plan view and cross-sectional view of an embodiment of a partially formed article of footwear.
Figure 21:
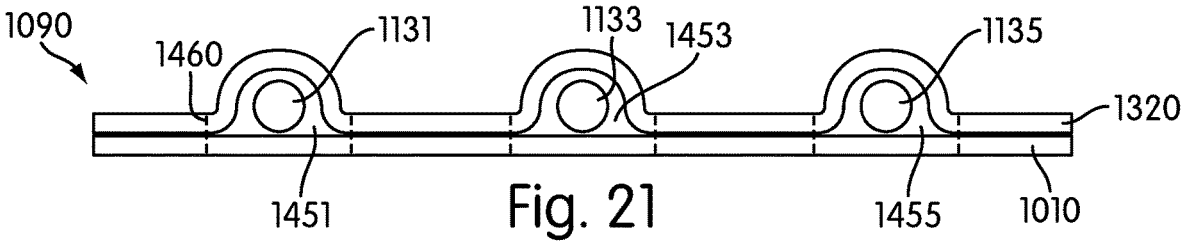

FIGS. 20-21 show another schematic and cross-sectional view of a partially formed article of footwear. In particular, the illustrations refer to step 912 of FIG. 9 and show a schematic view of first layer 1010, cord system 1159, and second layer 1320 and a cross-sectional view of portion 1090. Accordingly, the first stitching with the first thread 1270 may be removed. The removal may be completed by any known method, including soaking upper 30 in water or another solution or by cutting first thread 1270 with or without the use of a tool.

Once first thread 1270 is removed, cord system 1159 may be capable of moving more freely within the confines of the tunnel system. In some cases, cord system 1159 may still be stitched using second thread 1460 in some locations. Depending on the location of second thread 1460, cord system 1159 may have varying ability to move within the tunnel system. As illustrated, second thread 1460 is configured very close to cord element 1131, cord element 1133, and cord element 1135; therefore, little movement is possible besides the one-dimensional, longitudinal movement through the tunnel system. In other cases, second thread 1460 may not fit against cord system 1159 as snuggly, providing cord system 1159 with a greater amount of lateral movement.

Figure 22:
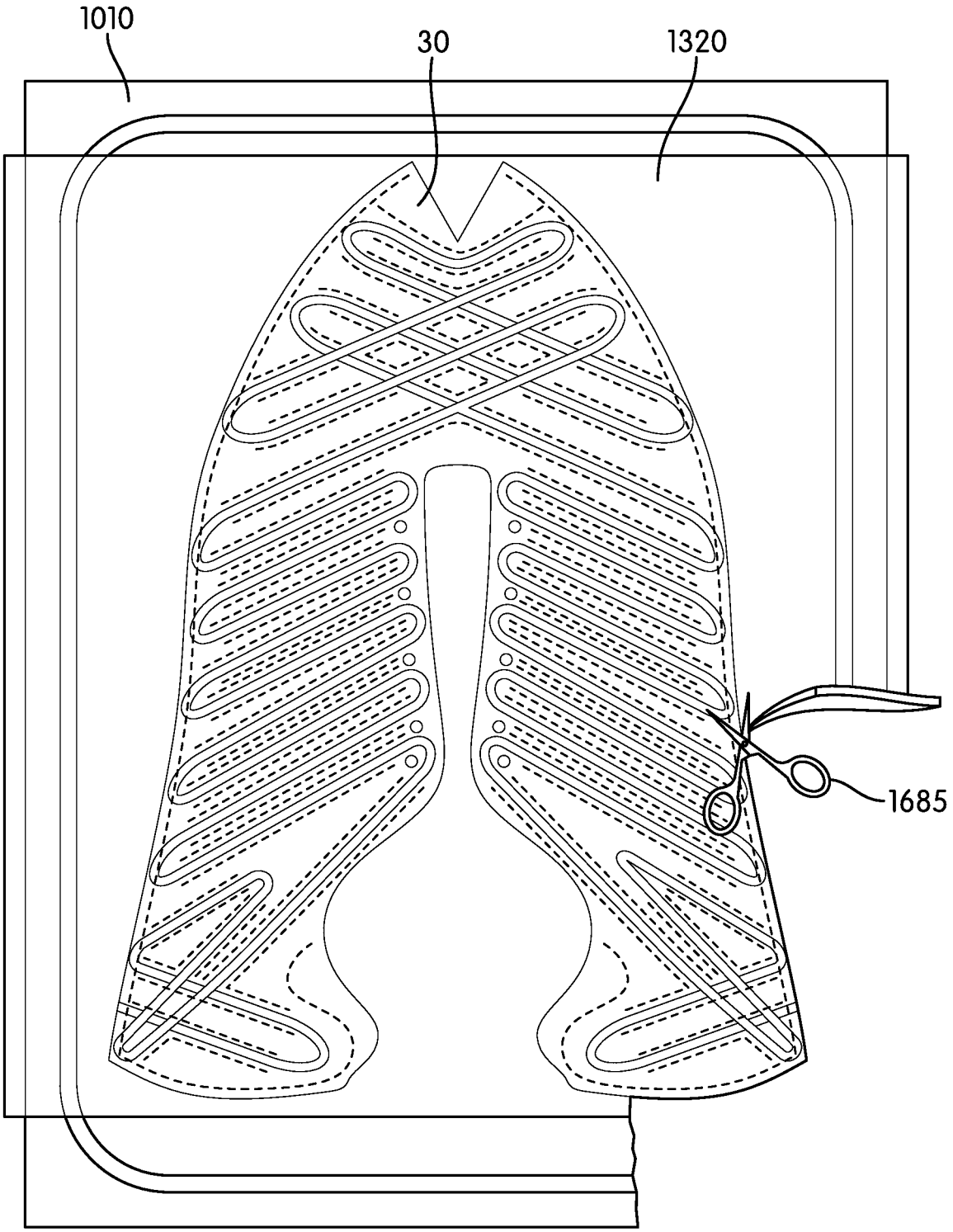
FIG. 22 is a schematic view of an additional step of cutting layers of an upper.

FIG. 22 shows an additional step for creating an upper. A method may include provisions for forming one or more layers into the shape of an upper. In some cases, FIG. 22 may be incorporated in step 916 of FIG. 9. In other cases, the step shown in FIG. 22 may be completed at other points, such has prior to step 902. An instrument may be used to properly shape first layer 1010 and second layer 1320. In some cases, hand instrument 1685, such as a pair of scissors, may be used. It will be appreciated that in other embodiments, any cutting tool may be used to shape first layer 1010 and second layer 1320. After the upper layers are cut, the combination of the upper layers and the cord system may remain in the shape of a flattened upper.

Figure 23:
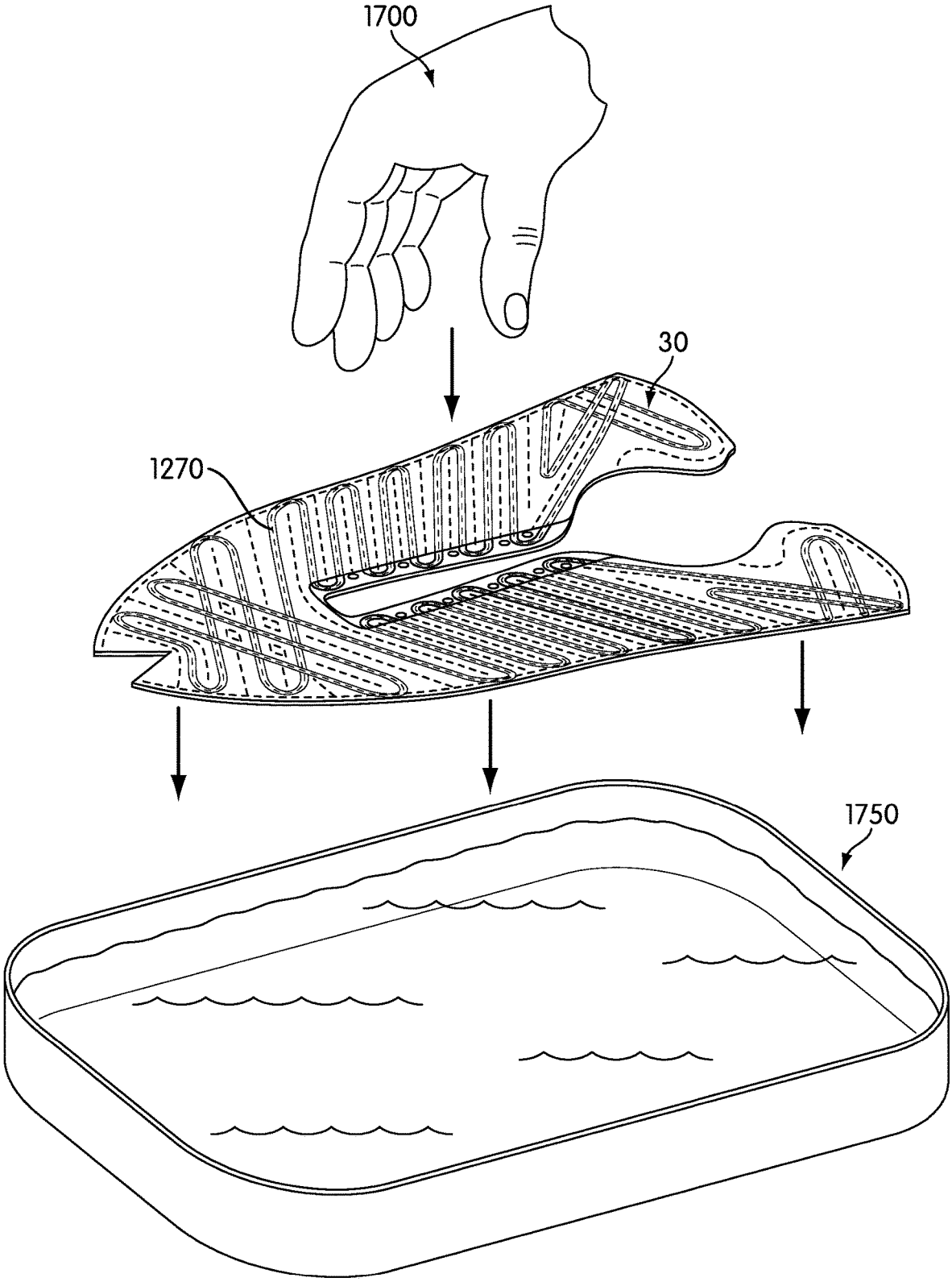
FIG. 23 is a schematic view of a process for removing a thread.
Figure 24:
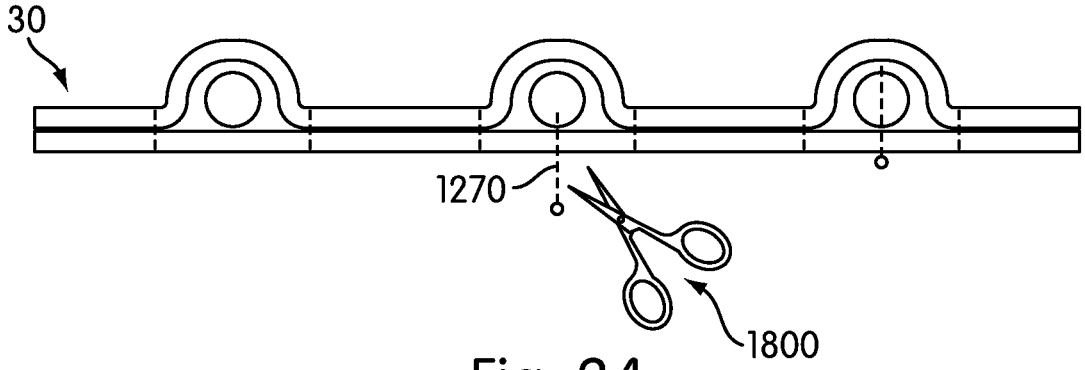
FIG. 24 is a schematic cross-sectional view of an alternative process for removing the first thread.

A method may also include provisions for removing thread from an upper. FIGS. 23-24 show a schematic view of a process of removing first thread 1270 from upper 30. In particular, the illustration refers to step 914 of FIG. 9. In FIG. 23, first thread 1270 may comprise a material that is capable of being dissolved in water or another solution. Accordingly, manufacturer 1700 may place upper 30 in a bowl of solution 1750. In some cases, upper 30 may need to be left in solution 1750 for a certain amount of time to assure that first thread 1270 is fully removed. Solution 1750 may be comprised of water or any other solution capable of dissolving first thread 1270. In some cases, first thread 1270 may be made of polar or charged ionic compounds to assist dissolving.

In an alternative embodiment, FIG. 24 shows another step for removing first thread 1270. In some cases, first thread 1270 may be removed by cutting first thread 1270 and pulling it out of upper 30. In some cases, first thread 1270 may be configured so a user can remove first thread 1270 by hand. In other cases, tool 1800 may be necessary or helpful to remove first thread 1270. As illustrated, tool 1800 may be a pair of scissors. It will be appreciated that any type of tool may be used including a typical household tool or a custom-made device. In some cases, first thread 1270 may be removed by a machine completing automated or computer-controlled movements.

Further Configurations

Figure 25:
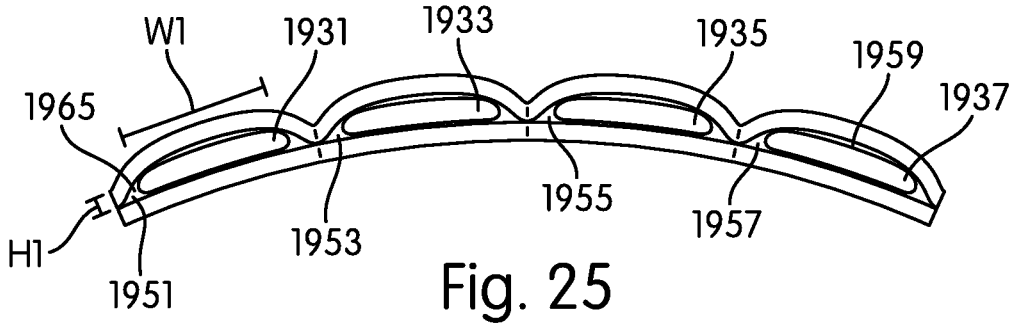
FIG. 25 is a cross-sectional view of an embodiment of a plurality of cord elements of cord a system.

FIGS. 25-29 show a cross-sectional view of an embodiment of plurality of cord elements of a cord system. FIG. 25 shows cord system 1959, including cord element 1931, cord element 1933, cord element 1935, and cord element 1937. Each cord element may be confined by tunnel system 1965, including tunnel 1951, tunnel 1953, tunnel 1955, and tunnel 1957. In some embodiments, cord system 1959 may be comprised of a flattened cord. The flattened cord may have a width W1 and a height H1. In some cases, width W1 may be substantially greater than height H1. In other cases, width W1 may be slightly greater than height H1. In still other cases height H1 may be slightly greater than width W1. In still other embodiments, height H1 may be substantially greater than width W1.

A flattened cord may prevent excessive protrusion outward of upper 30. This may result in stylistic advantages as well as advantages in packing and transporting upper 30. Also, a flattened cord may provide additional friction against tunnel system 1965, thereby providing additional support.

Figure 26:
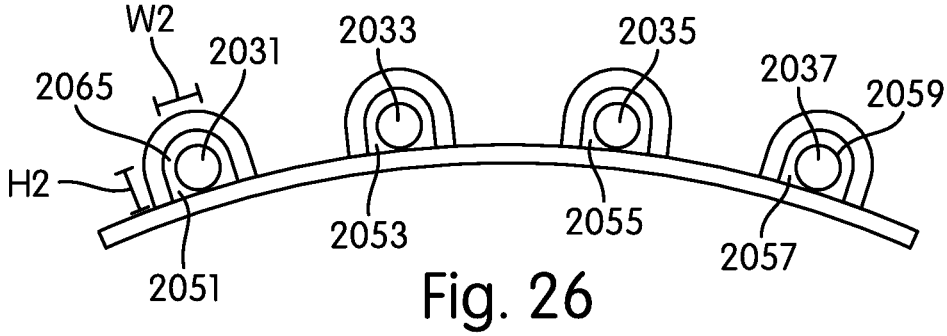
FIG. 26 is a cross-sectional view of an embodiment of a plurality of cord elements of cord a system.

In other embodiments, such as FIG. 26, cord system 2059 may comprise cord element 2031, cord element 2033, cord element 2035, and cord element 2037. Each cord element may be confined by tunnel system 2065, including tunnel 2051, tunnel 2053, tunnel 2055, and tunnel 2057. In some embodiments, cord system 2059 may comprise a rounded cord. The rounded cord may have a width W2 and a height H2. In some cases, width W2 may be substantially equivalent to height H2, hence providing a rounded cross-section. A rounded cord may have advantages of reduced friction within tunnel system 2065, thereby providing a user with additional control over cord system 2059. A rounded cord may also result in a simpler manufacturing process or stylistic advantages.

Upper 30 may include provisions for allowing a cord to move in a lateral direction within a tunnel system. Generally, a widened tunnel system may be used. Regarding FIGS. 27-29, cord system 2159 may further comprise cord element 2131, cord element 2133, and cord element 2135. Each cord element may be confined by tunnel system 2165, including tunnel 2151, tunnel 2153, and tunnel 2155. The illustration shows three configurations, configuration 2110 in FIG. 27, configuration 2120 in FIG. 28, and configuration 2130 in FIG. 29. Configuration 2110 refers to step 910 of FIG. 9. Configuration 2120 and configuration 2130 refer to step 912 of FIG. 9, after first thread 1270 has been removed. In some cases, the second stitching may be configured such that cord element 2135 may have substantial multi-dimensional movement within the confines of tunnel 2155. Such movement may include longitudinal movement and lateral movement. This greater degree of movement may provide a user with a greater flexibility when providing support to upper 30.

It will be appreciated that the shape and material of the cord system may not be consistent for all cord elements. In some cases, the cord system may comprise both flattened cord elements and rounded cord elements. Similarly, the fit of the tunnel may not be consistent for the entire tunnel system. In some cases, a tunnel may fit some cord elements loosely and other cord elements snuggly.

FIG. 30 shows an alternative configuration of the cord system of upper 2230. In some cases, cord system 2259 may not be located throughout upper 2230. In some cases, cord system 2259 may be located exclusively in midfoot region 12. In will be appreciated that in other embodiments cord system 2259 may instead be located exclusively in forefoot region 11, heel region 13, or any combination or permutation thereof. Similarly cord system 2259 may be limited to medial side 15 or lateral side 14.

FIG. 31 shows a schematic view of an upper with a fully stitched perimeter. It will be appreciated for the following figures that some of the stitching is shown schematically, providing less detail than the actual embodiment. In particular, second stitching may be configured such that the perimeter of upper 2330 is fully stitched by second thread 2360. Accordingly, cord system 2359 may be confined entirely to its movement within the tunnel system. Moreover, since several cord elements of cord system 2359 are sewn into the perimeter, the movement of cord system 2359 is even further restricted.

Alternatively, FIG. 32 shows a schematic view of upper 2430 with a fully stitched perimeter. However, in this illustration, cord system 2459 is not sewn into the perimeter with second thread 2460. Accordingly, the cord elements of cord system 2459 have an even greater range of motion through the tunnel system.

FIG. 33 shows a schematic view of upper 2530 with a partially stitched perimeter.

In some cases, second stitching with second thread 2560 may only be configured to surround a partial perimeter of upper 2530. Accordingly, some cord elements of cord system 2559 may be capable of movement outside the boundary of the upper, as shown.

FIG. 34 shows a schematic view of an article of footwear with a partially stitched perimeter. In some cases, one or more cord elements of cord system 2659 may be exposed outside of upper 2630. Cord system 2659 may comprise exposed cord element 2631, exposed cord element 2633, exposed cord element 2635, and exposed cord element 2637, and exposed cord element 2638, herein the exposed cord elements. While five cord elements are exposed as illustrated, it will be appreciated that any number of cord elements may be exposed, such as one, three, or seven. Similarly, the exposed cord elements are illustrated in midfoot region 12 on lateral side 14 of article of footwear 2600, but it will be appreciated that the exposed cord elements may be located on medial side 15, forefoot region 11, and heel region 13.

Article of footwear 2600 may include provisions for controlling the positions of exposed cord elements. In some cases, the exposed cord elements may be disposed on sole structure 20. In some cases, the exposed cord elements may be disposed on outsole 22. In other cases, the exposed cord elements may be disposed on midsole 21. As illustrated, the exposed cord elements are disposed using tack system 2670. Tack system 2670 may comprise tack 2671 to dispose exposed cord element 2631, tack 2673 to dispose exposed cord element 2633, tack 2675 to dispose exposed cord element 2635, tack 2677 to dispose exposed cord element 2637, and tack 2678 to dispose exposed cord element 2638. In some cases, the exposed cords may be capable of movement along each tack of tack system 2670. As an example, exposed cord element 2631 may be able to slide around tack 2671 as if there is increased pressure on one side of exposed cord element 2631. In still other embodiments, cord system 2659 may be disposed on apertures in sole structure 20. In some cases, when cord elements of the cord system have an increased freedom of movement around each tack in tack system 2620, article of footwear 10 may have increased control over the structural stability with lace 32.

Of course, other attachment mechanisms and configurations are possible. For example, the exposed cords may attach to caps, lugs, or nubs. The exposed cords may also be disposed in apertures in various locations of the sole structure. In some cases, the exposed cords may be disposed in a bottom portion of the outsole. In other cases, the exposed cords may be looped through an aperture in the midsole and reattached to the upper. By attaching the exposed cords to midsole 21 or outsole 22, upper 30 may have a more direct connection to sole structure 20, facilitating a more secure fit.

Although a single cord or cord system is discussed above and shown in the figures as being located in each tunnel, multiple cords may also be positioned in a tunnel. For example, first layer 1010 and second layer 1320 may be joined to form a tunnel that receives multiple sections of cord system 1159 or multiple cords. As such, a tunnel or other area between layers may receive more than one cord in some configurations.

As a further variation upon the structure discussed above, one or both of first layer 1010 and second layer 1320 may have areas that expose the cords. For example, second layer 1320 may form an aperture that exposes areas of the cords on the side of an article of footwear. This may be used to enhance the aesthetics of the footwear or reduce weight of the footwear.

Conclusion

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. An article of footwear comprising:

an upper;

a sole structure secured to the upper;

a support system extending from the sole structure to a lace region of the article, the support system extending along a side of the upper to define an outer surface of the article in a midfoot region of the article and having a lower portion coupled to the sole structure; and a cord comprising a plurality of unexposed portions and a plurality of exposed portions, wherein the support system defines a plurality of tunnels that extend from the lower portion of the support system to the lace region, a plurality of tunnel exits adjacent the lace region, and a plurality of pairs of tunnel exits that are adjacent to one another, wherein the unexposed portions of the cord extend within the plurality of tunnels of the support system from the lower portion to the lace region, and the exposed portions of the cord extend from the plurality of tunnel exits to form a plurality of lace apertures, each lace aperture being formed between a respective pair of the plurality of pairs of tunnel exits, and wherein the support system comprises a first layer and a second layer, the first layer being a lower layer and the second layer being an upper layer that extends over the lower layer with attachment regions such that the plurality of tunnels are formed between adjacent attachment regions of the first layer and the second layer to define the plurality of pairs of tunnel exits.

2. The article of footwear according to claim 1, wherein at least some of the plurality of tunnels intersect an adjacent one of the plurality of tunnels at the lower portion of the support system.

3. The article of footwear according to claim 1, wherein the support system extends upwards beyond the lace apertures to at least partially support a lace received in the lace apertures.

4. The article of footwear according to claim 1, wherein the cord has a flattened cross-sectional shape.

5. The article of footwear according to claim 1, wherein the cord is moveable longitudinally within the plurality of tunnels.

6. The article of footwear according to claim 1, wherein the cord is fixed along the lower portion of the support system.

7. The article of footwear according to claim 1, wherein the outer surface of the support system is raised at the location of the plurality of tunnels.

8. The article of footwear according to claim 1, wherein the support system comprises a first layer and a second layer, and the plurality of tunnels are formed between the first layer and the second layer.

9. The article of footwear according to claim 1, wherein the support system is attached to the upper.

10. The article of footwear according to claim 1, wherein the lace apertures are evenly spaced.

11. The article of footwear according to claim 1, wherein the outer surface of the support system is raised at the location of the plurality of tunnels.

12. An article of footwear comprising:

an upper;

a sole structure secured to the upper;

a support system extending from the sole structure to a lace region and across at least a midfoot region of the article, the support system comprising:

a plurality of tunnels extending from a lower portion of the support system to the lace region, each of the plurality of tunnels having a tunnel exit at the lace region;

a cord having enclosed cord portions positioned within the plurality of tunnels of the tunnel structure and exposed cord portions that extend out of the plurality of tunnels at the lace region of the tunnel structure, the exposed cord portions forming a plurality of lace apertures between adjacent pairs of tunnel exits, wherein the support system comprises a first layer that and a second layer, the first layer being a lower layer and the second layer being an upper layer that extends over the lower layer with attachment regions such that the plurality of tunnels are formed between adjacent attachment regions of the first layer and the second layer to define the plurality of pairs of tunnel exits.

13. The article of footwear according to claim 12, wherein at least some of the plurality of tunnels intersect an adjacent one of the plurality of tunnels at the lower portion of the support system.

14. The article of footwear according to claim 12, wherein the support system extends upwards beyond the lace apertures to at least partially support a lace received in the lace apertures.

15. The article of footwear according to claim 12, wherein the cord is longitudinally moveable within the plurality of tunnels.

16. The article of footwear according to claim 12, wherein the support system is attached to the upper.

17. The article of footwear according to claim 12, wherein the plurality of lace apertures are evenly spaced.

18. The article of footwear according to claim 12, wherein the support system has a lower portion coupled to the sole structure.

* * * * *